US005160204A

United States Patent [19]

Naito et al.

[11] Patent Number: 5,160,204

[45] Date of Patent: Nov. 3, 1992

[54] RIBBON ADAPTER AND RIBBON CASSETTE CAPABLE OF MOUNTING THE RIBBON ADAPTER AND RECORDING APPARATUS

[75] Inventors: Hisatsugu Naito; Shinya Asano, both of Tokyo, Japan

[73] Assignee: Canon Kabushiki Kaisha, Tokyo, Japan

[21] Appl. No.: 688,282

[22] Filed: Apr. 22, 1991

[30] Foreign Application Priority Data

Apr. 24, 1990 [JP] Japan ..... 2-106626
Apr. 24, 1990 [JP] Japan ..... 2-106627
Apr. 24, 1990 [JP] Japan ..... 2-106628

[51] Int. Cl.[5] ..... B41J 35/28

[52] U.S. Cl. ..... 400/208; 242/192; 400/247; 400/697.1

[58] Field of Search ..... 400/191, 194, 207, 208, 400/208.1, 223, 234, 247, 249, 697.1; 242/192

[56] References Cited

U.S. PATENT DOCUMENTS 4,512,674 4/1985 Suzaki et al. ..... 400/208
4,616,946 10/1986 Komplin ..... 400/208
4,900,171 2/1990 Mueller et al. ..... 400/249
4,971,462 11/1990 Mueller et al. ..... 400/208
4,983,056 1/1991 Falconieri et al. ..... 400/208
5,007,749 4/1991 Falconieri et al. ..... 400/208
5,044,794 9/1991 Shimoyama et al. ..... 242/192

FOREIGN PATENT DOCUMENTS 0244228 11/1987 European Pat. Off. .
0288596 11/1988 European Pat. Off. .
2624057 6/1989 France .
57-207084 12/1982 Japan .
0191184 11/1983 Japan ..... 400/223
61-112666 10/1986 Japan .

*Primary Examiner*—Eugene H. Eickholt
*Attorney, Agent, or Firm*—Fitzpatrick, Cella, Harper & Scinto

[57] ABSTRACT

A ribbon adaptor attachable to a recording apparatus comprises a ribbon loader for loading an ink ribbon, a ribbon feeder for feeding the ribbon loaded by the ribbon loader, a support frame member for supporting the ribbon loader and ribbon feeder, and an adaptor stopper provided on the frame member.

23 Claims, 18 Drawing Sheets

| |
|---|
| FIG. 16B-1 |
| FIG. 16B-2 |

| FIG. 16C-1 |
| --- |
| FIG. 16C-2 |

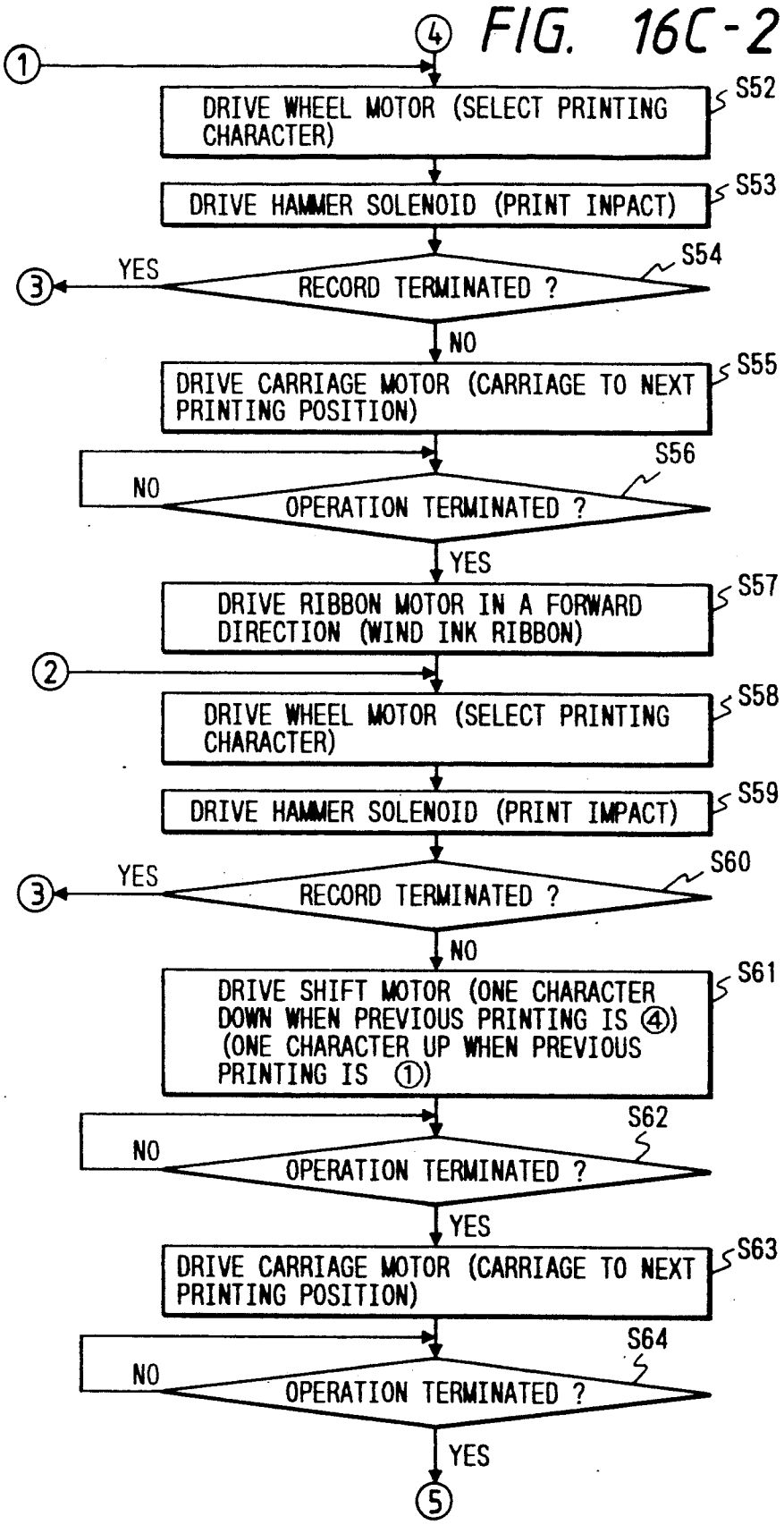
FIG. 16C-2
1
4
DRIVE WHEEL MOTOR (SELECT PRINTING CHARACTER)
S52
DRIVE HAMMER SOLENOID (PRINT INPACT)
S53
RECORD TERMINATED ?
S54
YES
3
NO
DRIVE CARRIAGE MOTOR (CARRIAGE TO NEXT PRINTING POSITION)
S55
OPERATION TERMINATED ?
S56
NO
YES
DRIVE RIBBON MOTOR IN A FORWARD DIRECTION (WIND INK RIBBON)
S57
2
DRIVE WHEEL MOTOR (SELECT PRINTING CHARACTER)
S58
DRIVE HAMMER SOLENOID (PRINT IMPACT)
S59
RECORD TERMINATED ?
S60
YES
3
NO
DRIVE SHIFT MOTOR (ONE CHARACTER DOWN WHEN PREVIOUS PRINTING IS 4) (ONE CHARACTER UP WHEN PREVIOUS PRINTING IS 1)
S61
OPERATION TERMINATED ?
S62
NO
YES
DRIVE CARRIAGE MOTOR (CARRIAGE TO NEXT PRINTING POSITION)
S63
OPERATION TERMINATED ?
S64
NO
YES
5

RIBBON ADAPTER AND RIBBON CASSETTE CAPABLE OF MOUNTING THE RIBBON ADAPTER AND RECORDING APPARATUS

BACKGROUND OF THE INVENTION

1. Field of the Invention

The present invention relates to a ribbon adapter and a ribbon cassette capable of mounting the ribbon adapter on a recording apparatus.

2. Related Background Art

Nowadays, a variety of recording apparatuses for recording input information have been developed. For example, in an electronic typewriter, printing is performed onto plain paper by loading an ink ribbon into a carriage and transcribing ink of the ink ribbon onto the paper. And in the electronic typewriter, misprints can be generally corrected by using a correcting ribbon and peeling off misprinted ink from a recording sheet with the correcting ribbon.

A constitution for loading the correcting ribbon is conventionally based on a method of directly loading the correcting ribbon into a carriage, or a method of constructing the correcting ribbon as a cassette and loading such a correcting ribbon cassette into the carriage.

However, with the above method of directly loading the correcting ribbon into the carriage, an operator has to enter his hand into the inside of a recording apparatus to load the correcting ribbon into a winding mechanism, which requires labor and time.

With the method of loading the correcting ribbon cassette, the loading of the correcting ribbon is simpler, but a problem arises such that parts for cassettes may increase, thereby causing high cost.

On the other hand, in conventional recording apparatuses, separate motors were used for winding the correcting ribbon and the ink ribbon when the correcting ribbon was loaded. Therefore, the driving circuits for driving respective motors were separately needed, so that the number of parts increased, thereby raising the cost of the product. Also, a space for allocating the respective motors as above indicated was required, and it became troublesome to miniaturize the apparatus.

SUMMARY OF THE INVENTION

An object of the present invention is to provide a ribbon adaptor and a ribbon cassette capable of mounting the ribbon adaptor on a recording apparatus with the operativity increased.

Another object of the present invention is to resolve the above-mentioned conventional problems, and to provide a ribbon adaptor and a ribbon cassette for attachment of the ribbon adaptor and a recording apparatus, in which a correcting ribbon can be loaded into the recording apparatus in a simple manner.

Another object of the present invention is to provide a recording apparatus in which the miniaturization of the apparatus has been accomplished.

Another object of the present invention is to resolve the above-mentioned conventional problems, and to provide a recording apparatus which can be miniaturized and has a decrease in cost by reducing the number of parts.

Another object of the present invention is to provide a ribbon adaptor and a recording apparatus for use with the ribbon adaptor which can be automatically placed in a lock state by operating the recording apparatus, even if locking the of ribbon adaptor is forgotten.

DETAILED DESCRIPTION OF THE PREFERRED EMBODIMENTS

An example of the present invention applied to an electronic typewriter will be described in the following.

Note that in the example as will be described below, a ribbon adaptor can be simply attached to a ribbon cassette by interlocking adaptor stopping means to adaptor attachment means of a ribbon cassette. Accordingly, correction of a misprint can be performed with a correcting ribbon by attaching the ribbon adaptor having the correcting ribbon to the ribbon cassette, and mounting the ribbon cassette to a recording apparatus. Further, in the recording apparatus having the adaptor attachment means, the ribbon adaptor can be attached easily to the recording apparatus by interlocking adaptor stopping means to the attachment means.

FIRST EXAMPLE

In this example, a ribbon adaptor, a ribbon cassette for attachment of the ribbon adaptor, and a recording apparatus to which the ribbon cassette is mounted will be described in this designated order.

Figure 1:
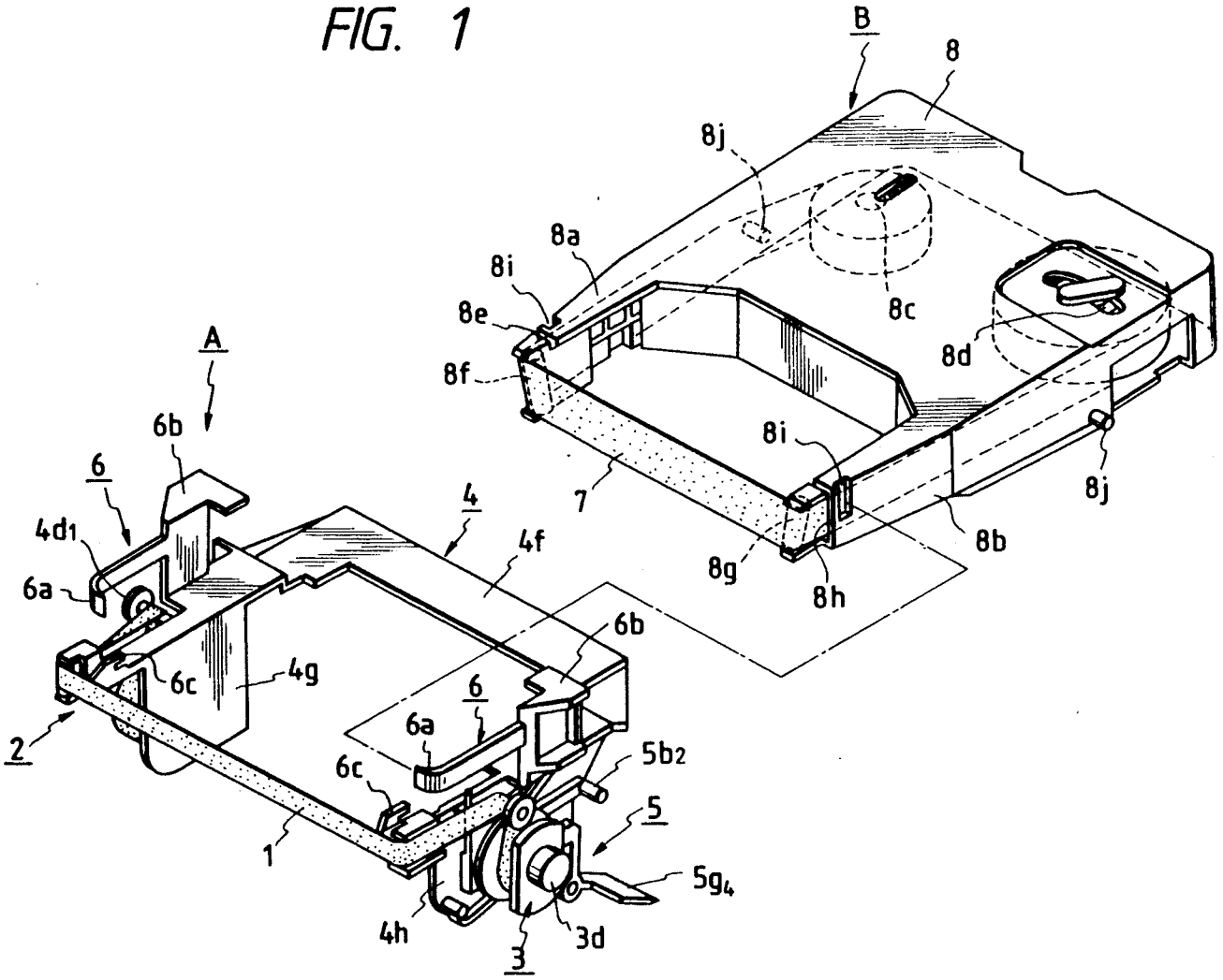
FIG. 1 is a perspective explanation view of a ribbon adaptor and a ribbon cassette.
Figure 2A:
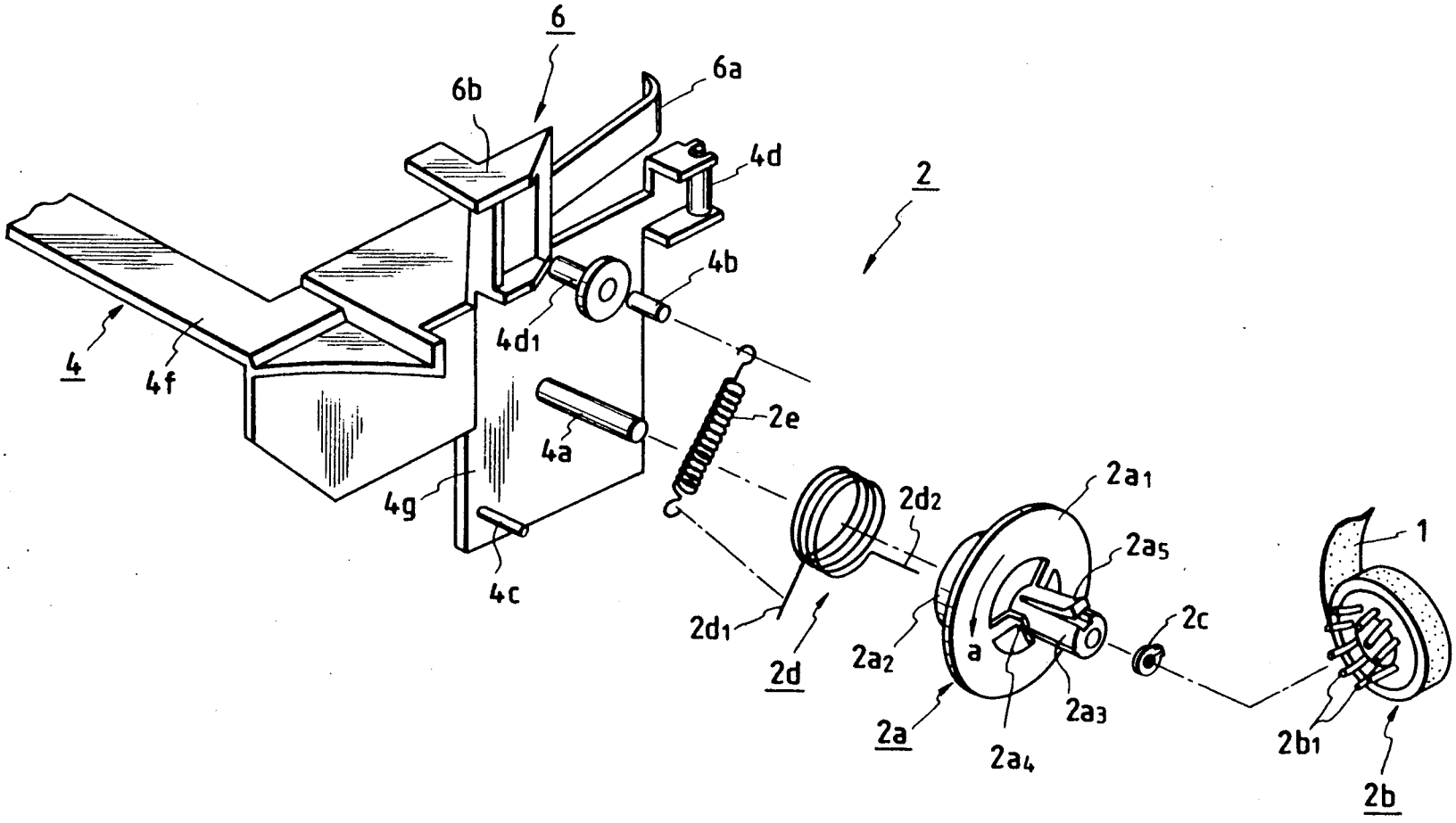
FIGS. 2A and 2B are exploded explanation views showing parts for the ribbon adaptor.
Figure 2B:
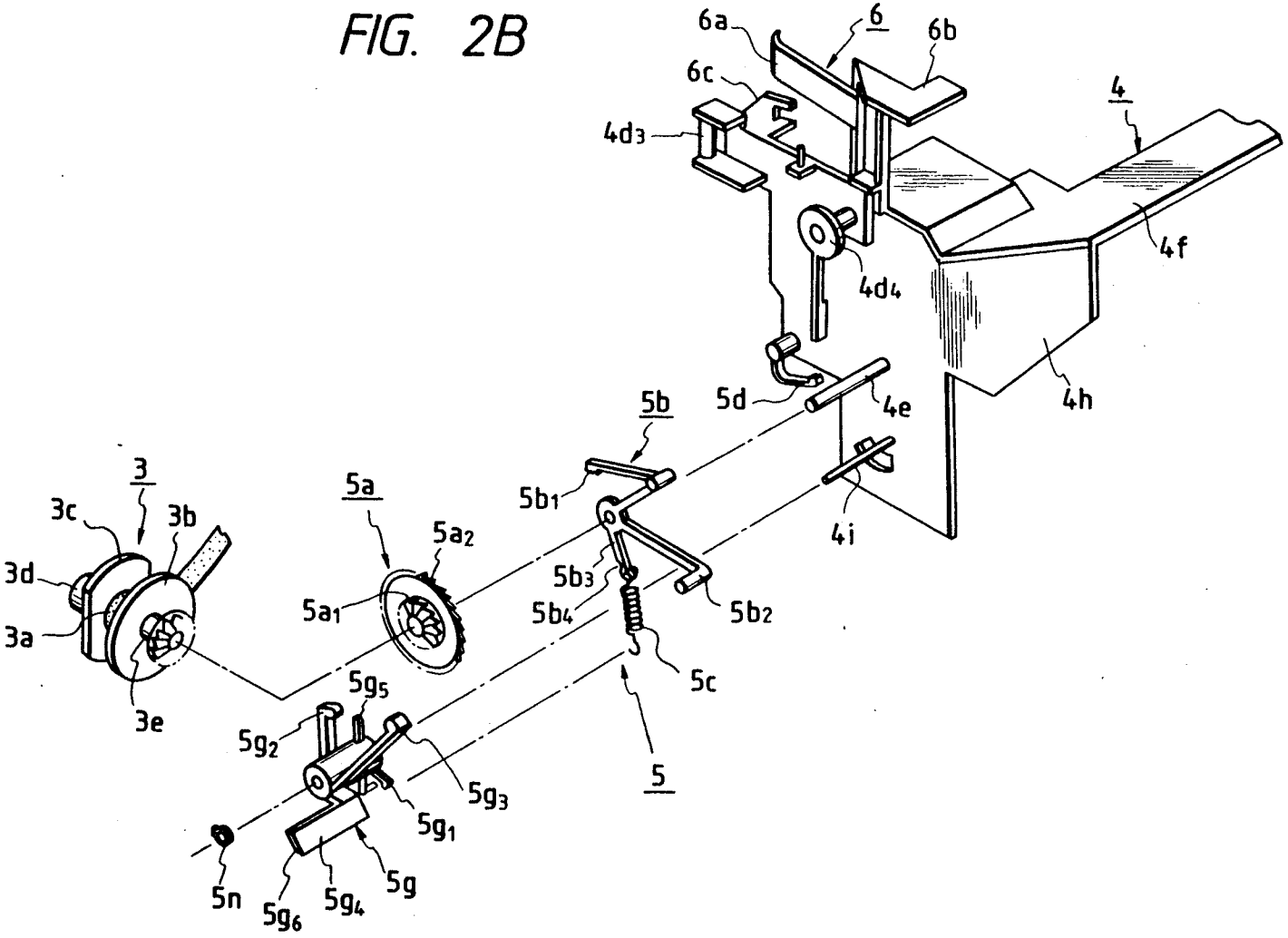

FIG. 1 is a perspective view of a ribbon adaptor A and a ribbon cassette B, FIG. 2B is an exploded explanation view showing parts for a ribbon supply portion of ribbon adaptor A, and FIG. 2B is an exploded explanation view of a ribbon winding portion and a ribbon feed mechanism of ribbon adaptor A.

RIBBON ADAPTOR

First, a constitution of ribbon adaptor A will be described.

GENERAL EXPLANATION

Figure 16A:
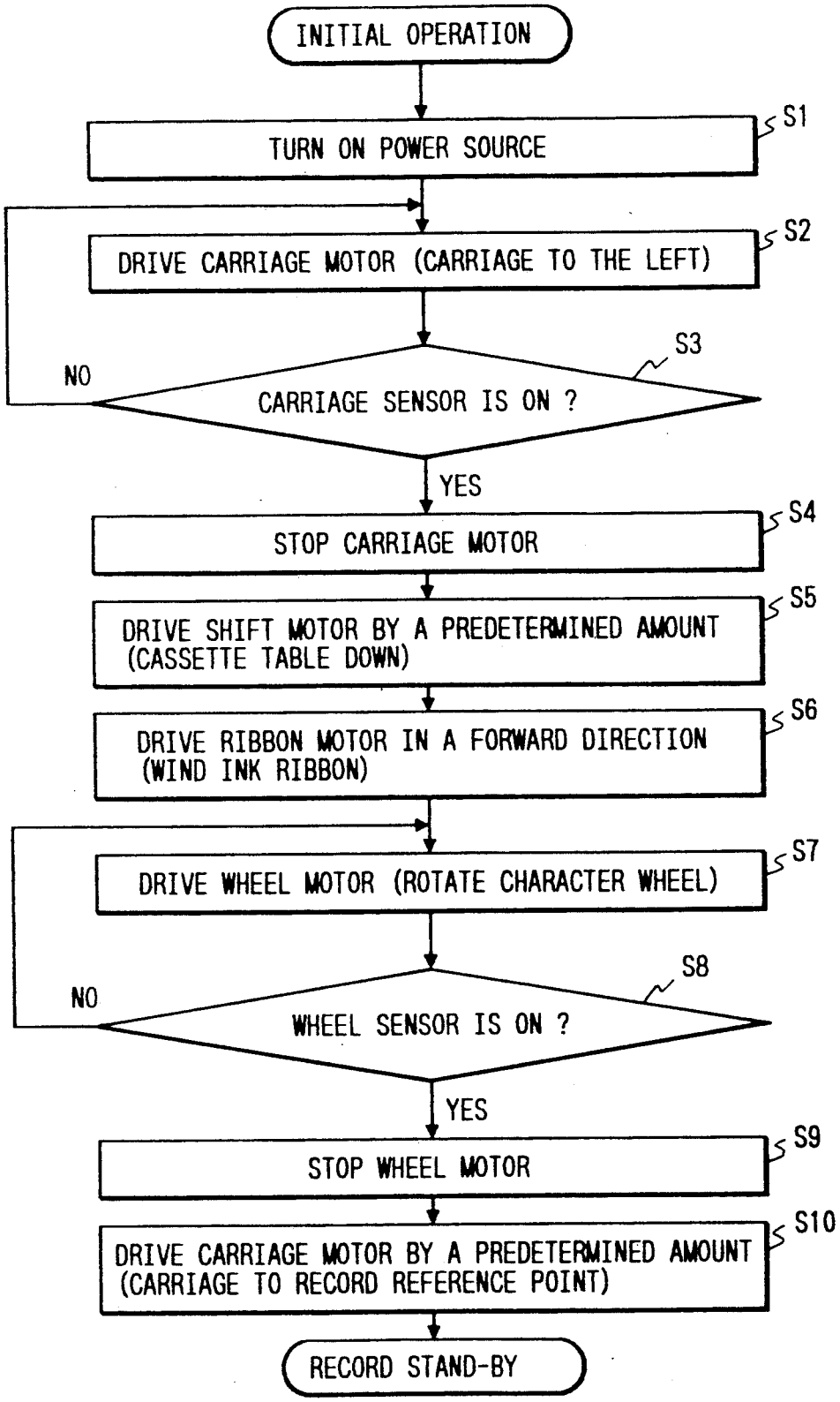
FIGS. 16A, 16B and 16C are flowcharts showing a correction procedure, with FIG. 16B comprising flowcharts 16B-1 and 16B-2 and FIG. 16C comprising flowcharts 16C-1 and 16C-2.
Figures 1, 16B:
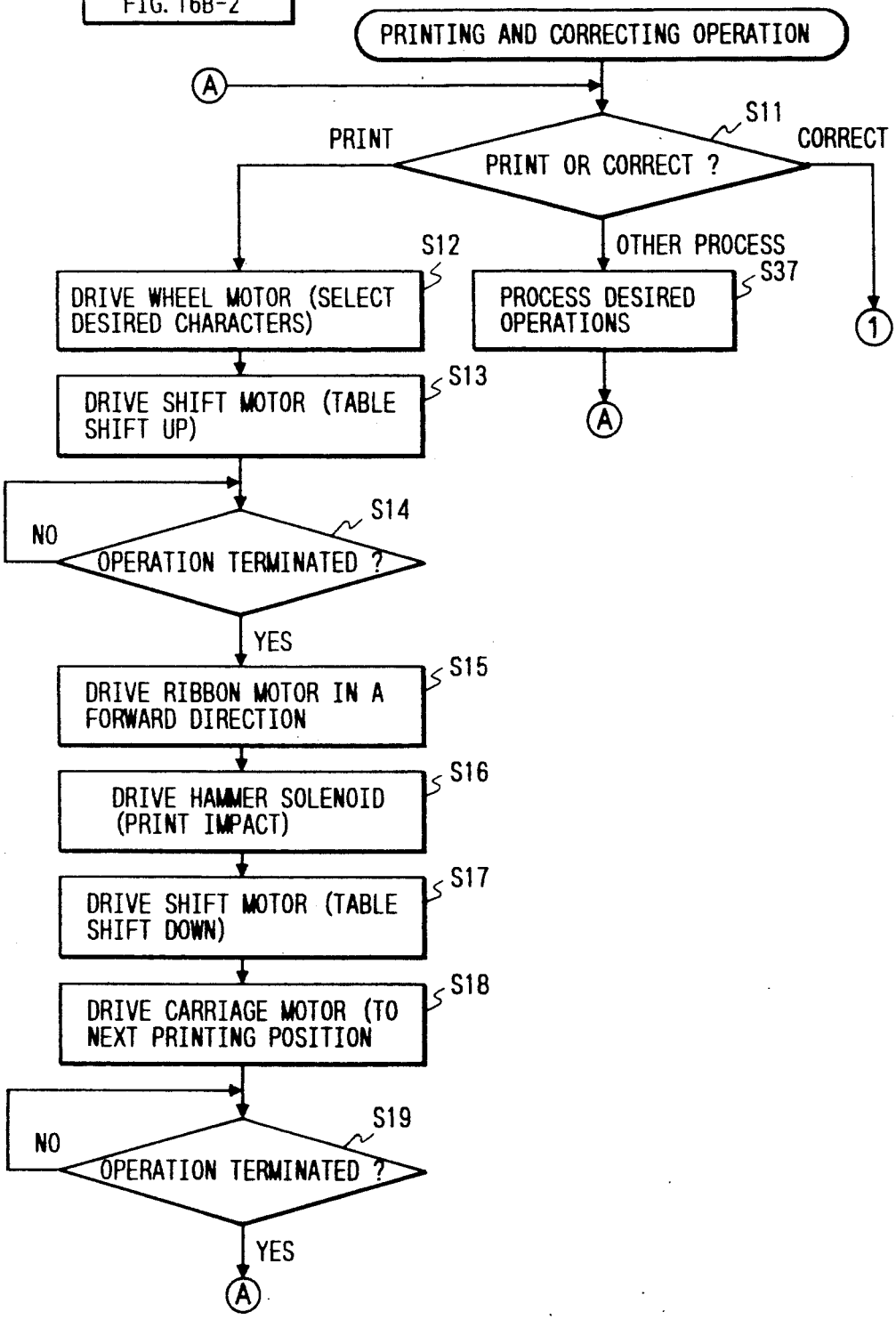
Figures 2, 16B:
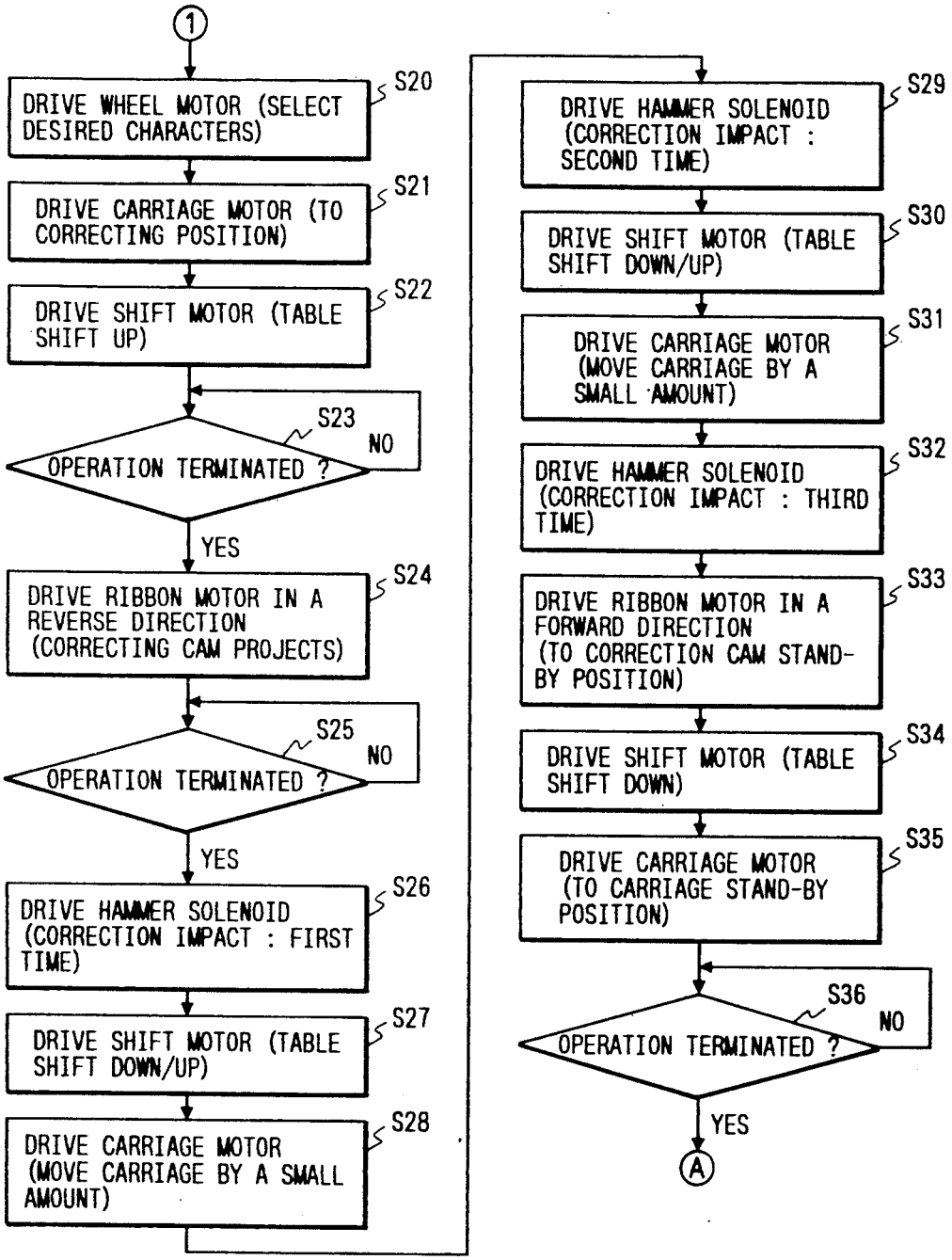

The ribbon adaptor A has a correcting ribbon 1 from supply means 2 wound around winding means 3, as shown in FIGS. 2 and 3, both means 2 and 3 being rotatably mounted on a support frame body. The ribbon adaptor A is provided with ribbon feed means 5, which allows the correcting ribbon 1 to be drawn out from the supply means 2 and wound around the winding means 3.

Further, the support frame body 4 is provided with adaptor stopping means 6 to be used in attaching the ribbon adaptor A to a ribbon cassette B as will be described later.

The constitution for each section of ribbon adaptor A will be specifically described in the following.

SUPPLY MEANS

The supply means 2 is used to draw out the correcting ribbon 1 wound therein, wherein as shown in FIG. 2A, a spool support member 2a is rotatably mounted around a spool shaft 4a of support frame body 4, and a supply spool 2b having the correcting ribbon 1 wound therearound is mounted to the spool support member 2a.

The spool support member 2a has a base portion $2a_2$ on one side of collar portion $2a_1$, and has a spool interlock portion $2a_3$ formed projectingly from the other side thereof. And the spool interlock member $2a_3$ has an interlock projection $2a_4$ projected therefrom, wherein if the supply spool 2b fits into the spool interlock portion $2a_3$, interlock projections $2b_1$ provided on the spool 2b are secured at the interlock projection $2a_4$, thereby causing the spool support member 2a and supply spool 2b to be rotated together. The spool interlock portion $2a_3$ is provided with an interlock projection $2a_5$, which can prevent the supply spool 2b fitted thereto from falling off the spool interlock portion $2a_3$.

The spool support member 2a is rotatably mounted on the spool shaft 4a, on a top end of which a stop ring 2c is provided to prevent it from falling off the shaft 4a.

Also, a torsion coil 2d like a one-way clutch is mounted on the base portion $2a_2$ of spool support member 2a, wherein one end $2d_1$ of the coil 2d is hooked by one end of a tension spring 2e, the other end of which is hooked to an interlock projection 4b of support frame body 4.

The torsion coil 2d is wound to tighten the base portion $2a_2$ when the spool support member 2a is rotated in a direction of arrow a as indicated in FIG. 2B (direction where the supply spool 2b draws out the correcting ribbon 1), or to loosen the tightness if being rotated in a reverse direction. Accordingly, if the spool support member 2a is rotated in the direction of arrow a in drawing out the ribbon, the coil 2d is rotated together with the spool support member 2a, and thereby the tension spring 2e is tensioned along a circumferential surface of base portion $2a_2$. And if the spool support member 2a is further rotated, a free end $2d_2$ of coil 2d is brought into contact with the interlock projection 4b, thereby limiting the rotation of coil 2d. Accordingly, when the correcting ribbon 1 is drawn out from the supply spool 2b, the tension spring 2e applies a certain tensile force to the correcting ribbon 1.

Note that a restraining projection 4c protruding from the support frame body 4 serves to restrain the rotation of coil 2d, because the coil end portion $2d_1$ abuts thereon when the spring support member 2a is rotated in a direction opposite to the arrow a.

The correcting ribbon 1 wound around the supply ribbon 2b comprises a paste layer formed on a long strip base film. And the ribbon 1 is guided from a collar guide roller 4d, via a guide roller $4d_2$, further from a guide roller $4d_3$ via a collar guide roller $4d_4$ to a take-up spool 3 which is winding means, as shown in FIGS. 2A and 2B.

WINDING MEANS AND RIBBON FEED MEANS

Winding means serves to wind the correcting ribbon 1 drawn out from the supply means 2, wherein in this example, the take-up spool 3 is rotatably mounted on the support frame body 4 to wind the ribbon 1 therearound.

The take-up spool 3 is provided with collars 3b, 3c on both sides of ribbon take-up portion 3a, and a knob portion 3d on an outer side of the collar portion 3c, as shown in FIG. 2B. Also, on an inner side of the collar portion 3b is provided a serration portion 3e which can mate with a serration portion $5a_1$ provided on a side face of a ratchet wheel 5a. The take-up spool 3 is rotatably mounted on the spool shaft 4e protruding from the support frame body 4, by interposing the ratchet wheel 5a and a feed lever 5b therebetween.

The ratchet 5a is also rotatably mounted on the spool shaft 4e. On a circumferential portion of ratchet wheel 5a is provided a toothed portion $5a_2$, which is engaged by a feed pawl $5b_1$ of feed lever 5b to constitute a ratchet mechanism. The ratchet mechanism rotates the ratchet wheel 5a in a direction of arrow c owing to the engagement of the feed pawl $5b_1$ with the toothed portion $5a_2$, when the feed lever 5b mounted for rotation on the spool shaft 4e is rotated in a direction of arrow b as indicated in FIG. 3B. At this time, the take-up spool 3 with the serration portions 3e, $5a_1$ mating with each other is also rotated integrally. When the feed lever 5b is rotated in a direction of arrow d as indicated in FIG. 3A, the feed pawl portion $5b_1$ can not mate with the toothed portion $5a_2$, so that the ratchet wheel 5a is not rotated.

Figure 3A:
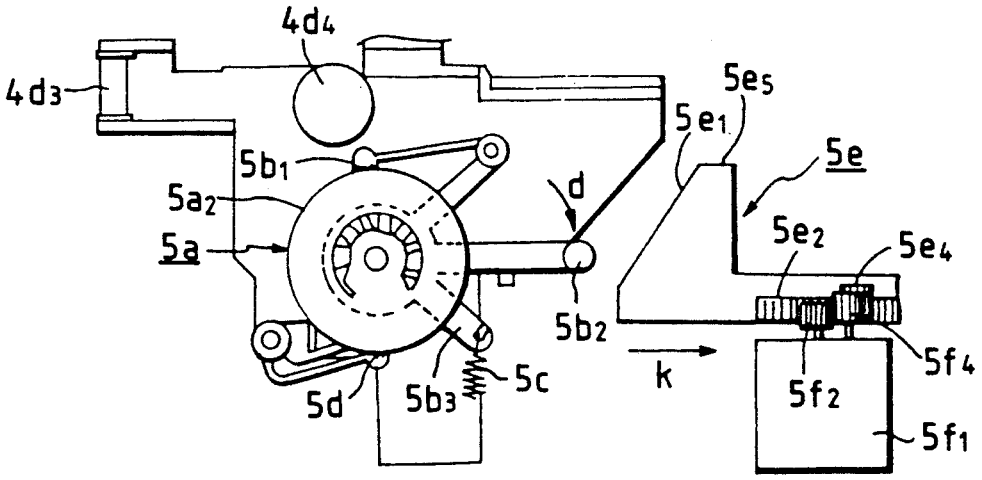
FIGS. 3A and 3B are explanation views showing the delivery of a correcting ribbon.
Figure 3B:
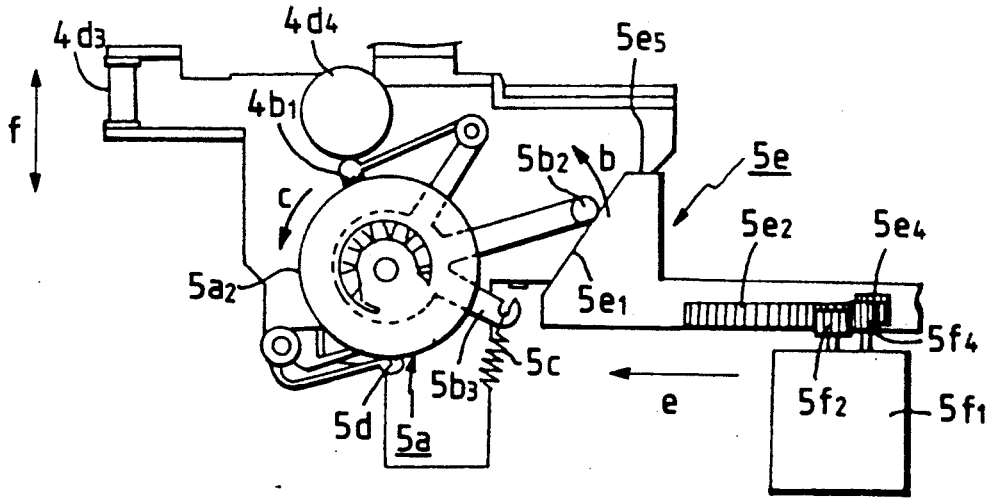

The feed lever 5b has an interlock projection portion $5b_3$ protruding therefrom, and is always urged to the direction of arrow d as indicated in FIG. 3A, owing to a tension spring 5c extended between the projection portion $5b_3$ and a hook portion $5g_1$ of lock lever 5g as will be described.

Further, a backstop pawl 5d is provided on a side face of the support frame body 4, as shown in FIGS. 3a and 3b, and can mate with the toothed portion $5a_2$ of ratchet wheel 5a. The back-stop pawl 5d does not mate with the toothed portion $5a_2$ when the ratchet wheel 5a is rotated in a direction of arrow c as indicated in FIG. 3B, while in rotating in a direction opposite to the arrow c, it can mate with the toothed portion $5a_2$, thereby restraining the rotation of ratchet wheel 5a.

Accordingly, if the ratchet wheel 5a is rotated in the direction of arrow c by moving the lever portion $5b_2$ of feed lever 5b up and down, as shown in FIGS. 3A and 3B, the correcting ribbon 1 can be drawn out from the supply spool 2b while being wound around the take-up spool 3. In this example, as shown in FIG. 3B, an inclined cam face $5e_1$ or plane portion $5e_5$ is contacted by the lever portion $5b_2$, thereby to press it upward, by sliding a correction cam 5e that is an abutting member in a direction of arrow e. And further, in this state, the lever portion $5b_2$ can be moved up and down by shifting a ribbon cassette B having a ribbon adaptor A attached thereto in the direction of arrow f as indicated in FIG. 3B, i.e., up and down.

DRIVING MECHANISM OF CORRECTION CAM

A driving mechanism for sliding the correction cam 5e will be described below.

Figure 4A:
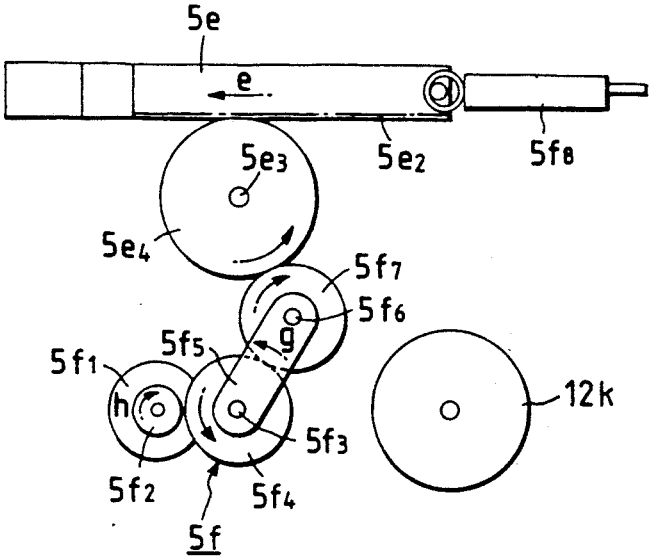
FIGS. 4A–4C are explanation views showing the transmission of driving force to a correction cam and to the winding of an ink ribbon.
Figure 4B:
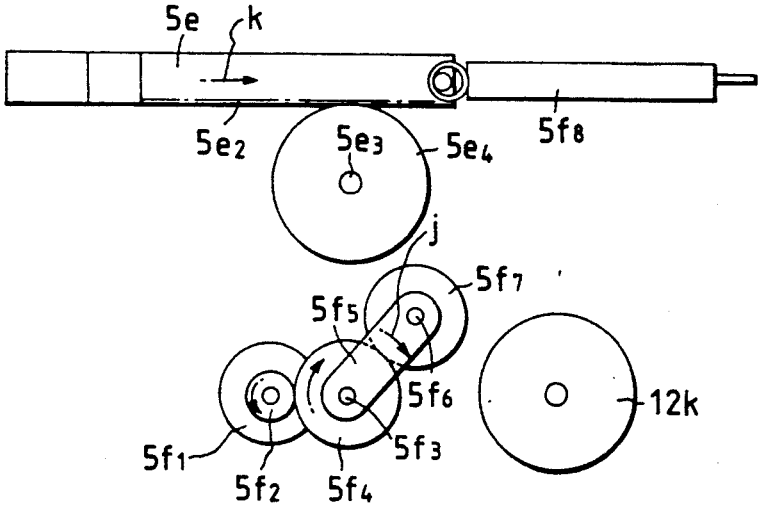
Figure 4C:
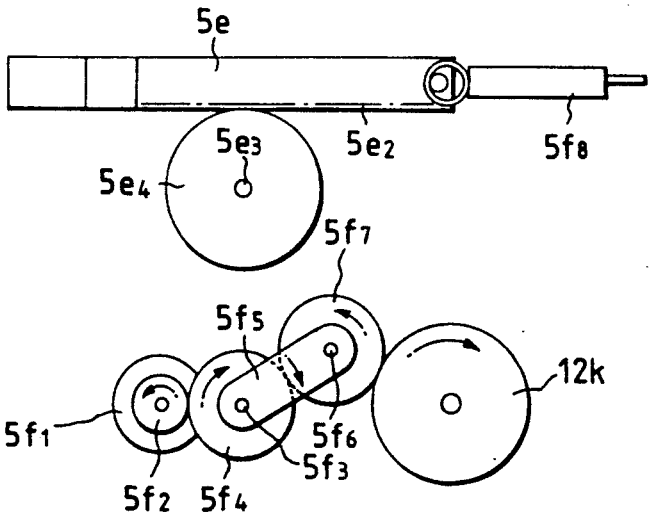

The correction cam 5e is slidably mounted on a carriage as will be described later, and a rack $5e_2$ is provided on a side face of the correction cam 5e, as cam gear $5e_4$ rotatable around an axle $5e_3$ as shown in FIGS. 4A–4C, wherein the correction cam 5e is constituted to be slidable on the carriage with the rotation of the cam gear $5e_4$.

The transmission of driving force to the cam gear $5e_4$ is performed by driving means 5f as shown in FIGS. 4A–4C. The driving means 5f includes a pinion gear $5f_2$ mounted on a motor shaft of ribbon motor $5f_1$, which mates with an idler gear $5f_4$ rotatable around a shaft $5f_3$ mounted on the carriage. And an arm portion $5f_5$ is rotatably supported around the shaft 5f3. On a top end of the arm $5f_5$, an idle gear $5f_7$ rotatable around a shaft $5f_6$ is removably supported, and mates with the idler gear $5f_4$. And the idle gear $5f_7$ is mounted on the arm portion $5f_5$ so as to have a certain rotation load due to a wave form washer, not shown. Accordingly, if the idler gear $5f_4$ is rotated, the idler gear $5f_7$ is rotated around a periphery of idler gear $5f_4$ along with the rotation of arm $5f_5$, while mating with the idler gear $5f_4$. And the idler gear $5f_7$ mates with the cam gear $5e_4$ when the arm $5f_5$ is rotated in a direction of arrow g as indicated in FIG. 4A.

Accordingly, if the ribbon motor $5f_1$ is driven in a reverse direction (rotation in a direction of arrow h as indicated in FIG. 4A), with the idle gear $5f_7$ mating with the cam gear $5e_4$ as shown in FIG. 4A, the correction cam 5e is moved in a direction of arrow e, and the cam face $5e_1$ forces the lever portion $5b_2$ of feed lever 5b upward in a direction of arrow b, as indicated in FIG. 3B, thereby causing the correction ribbon 1 to be wound around the take-up spool 3. Further, if the ribbon adaptor A is shifted up and down, with the inclined cam face $5e_1$ or plain portion $5e_5$ being contacted by the lever portion $5b_2$, the correction ribbon 1 is further wound around the take-up spool 3. More particularly, by shifting the adaptor A downward, the lever portion $5b_2$ is forced upward to wind the correction ribbon 1. When the adaptor A is shifted upward, the correction ribbon 1 does not return backward, even if the lever portion $5b_2$ may return with the backstop pawl 5d as will be described.

Note that the correction cam 5e has a tension spring $5f_8$ mounted therein, as shown in FIGS. 4A–4C. Accordingly, if the ribbon motor $5f_1$ is driven in a forward direction (rotation in a direction of arrow i as indicated in FIG. 4B), the arm $5f_5$ is rotated in a direction of arrow j, releasing the mating between the gear $5f_7$ and the cam gear $5e_4$, so that the correction cam 5e will retract by sliding in a direction of arrow k with the tensile force of tension spring $5f_8$, as shown in FIG. 4B. At this time, the feed lever 5b is rotated in a direction of arrow d owing to the tension spring 5c, as shown in FIG. 3A, the ratchet wheel 5a can not be rotated due to the backstop pawl 5d for preventing a reverse rotation.

If the arm $5f_5$ is rotated in the direction of arrow j, as previously described, the idle gear $5f_7$ mates with the ribbon gear 12k, as shown in FIG. 4C. The ribbon gear 12k is mounted on the carriage 12b (FIG. 11), and connected to a winding reel for winding an ink ribbon as will be described. Accordingly, the ink ribbon can be wound around the winding reel because it is rotated by driving the ribbon motor $5f_1$ in a forward direction. Thereby, with only one motor, the operation of correction cam 5e and the winding of ink ribbon are enabled.

LOCK MEANS FOR RIBBON ADAPTOR

Figure 5:
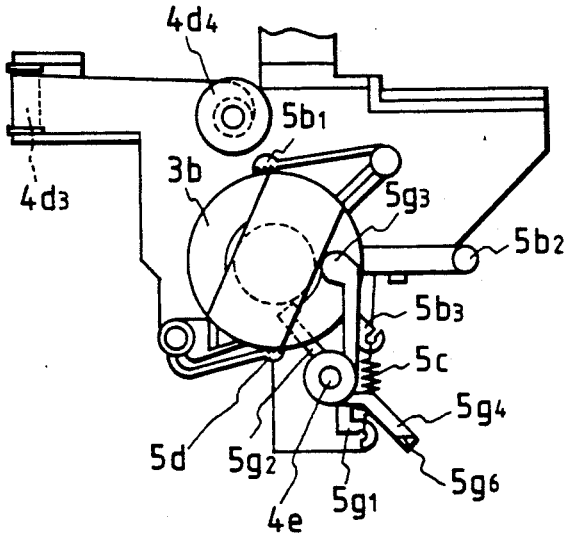
FIG. 5 is an explanation view showing a lock state of a take-up spool with a lock lever.

Next, the lock lever 5g will be described. The lock lever 5g constitutes means for locking a take-up spool 3 mounted on the spool shaft 4e to prevent it from falling off, and is mounted rotatably on a lever shaft 4i protruding from a side face of support frame body 4 as shown in FIG. 2B, and using the stop ring 5h so as not to fall off the shaft 4i. The lock lever 5g has a first lock portion $5g_2$ and a second lock portion $5g_3$ as shown in FIGS. 2B and 5. The first lock portion $5g_2$ presses on a side face of serration portion 3e of the take-up spool 3 mounted on the spool shaft 4e, while the second lock portion $5g_3$ presses on a side face of collar portion 3b as well as a correction ribbon wound around the take-up spool 3. Thereby, the take-up spool 3 mounted on the spool shaft 4e is restrained from moving in a thrust direction, and locked not to fall off from the spool shaft 4e.

Figure 6:
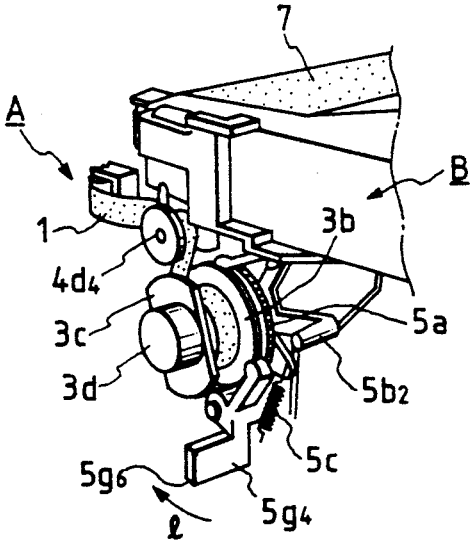
FIG. 6 is an explanation view showing a state where the take-up spool is mounted by disengaging the lock lever.

When the take-up spool 3 is mounted on the spool shaft 4e, it is necessary to retract and disengage therefrom the lock portions $5g_2$, $5g_3$ by rotating manually a lever portion $5g_4$ in a direction of arrow 1, as shown in FIG. 6. Thereby, a lock released state of lock member 5g engages an interlock recess $5b_4$ provided on a projection portion $5b_3$ of feed lever 5b, as shown in FIG. 2B.

And after the take-up spool 3 is mounted on the spool shaft 4e, the engagement as above described is disengaged by rotating the lever portion $5g_4$ in a direction opposite to the arrow 1, so that the take-up spool 3 is locked not to fall off.

AUTOMATIC LOCK CONSTITUTION

In this example, the lock member 5g can be automatically locked in a lock released state when the ribbon adaptor A is used.

Figure 7:
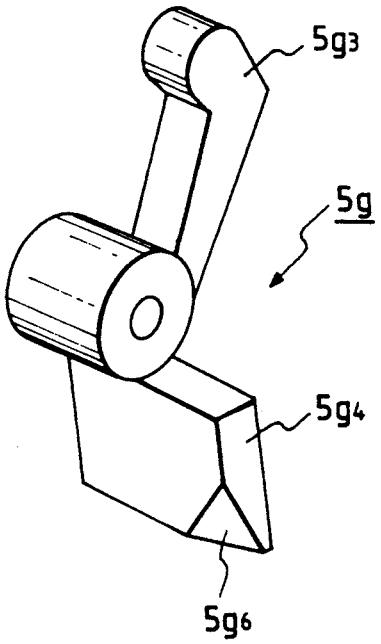
FIG. 7 is an explanation view of the lock lever.

Such a constitution is shown in FIG. 7. In the same figure, a beveled face $5g_6$ is provided on a corner portion of level portion $5g_4$ in the lock member 5g, and is placed into contact with a frame of the recording apparatus in a lock released state. That is, a ribbon adaptor A is attached to a ribbon cassette B in the lock released state of lock member 5g, as shown in FIG. 8A, and the ribbon cassette B is mounted to the carriage 12b of recording apparatus C. And in the correction operation, if the carriage 12b moves to a leftmost end of its movement range in the initial operation after turning on the power, the beveled face $5g_6$ is contacted by an inclined portion $13a_1$ of frame 13a and rides on the inclined portion $13a_1$, wherein the lock lever 5g is subject to a rotational force in a direction of arrow m as indicated in FIG. 8A.

Figure 8B:
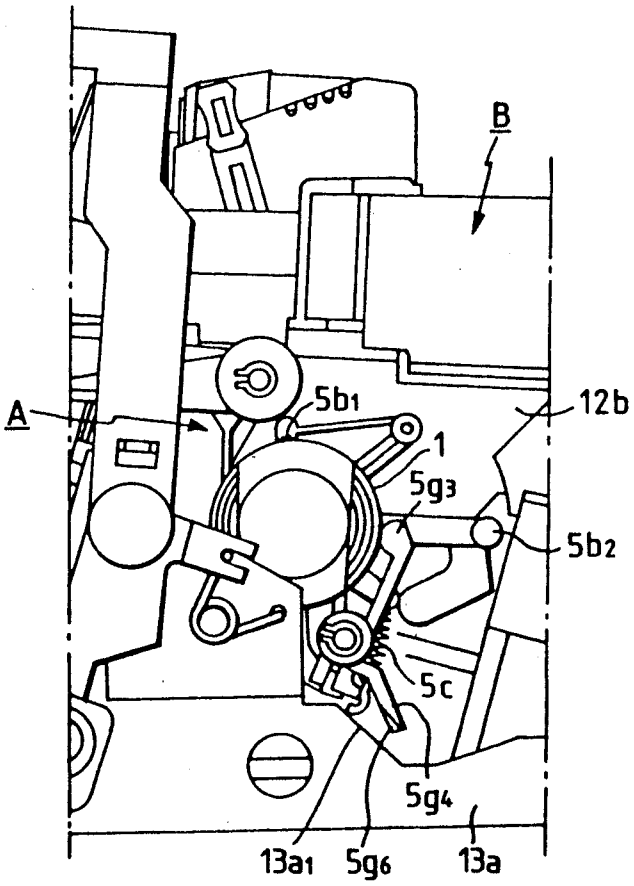
FIGS. 8A and 8B are explanation views of an automatic lock construction.
Figure 8A:
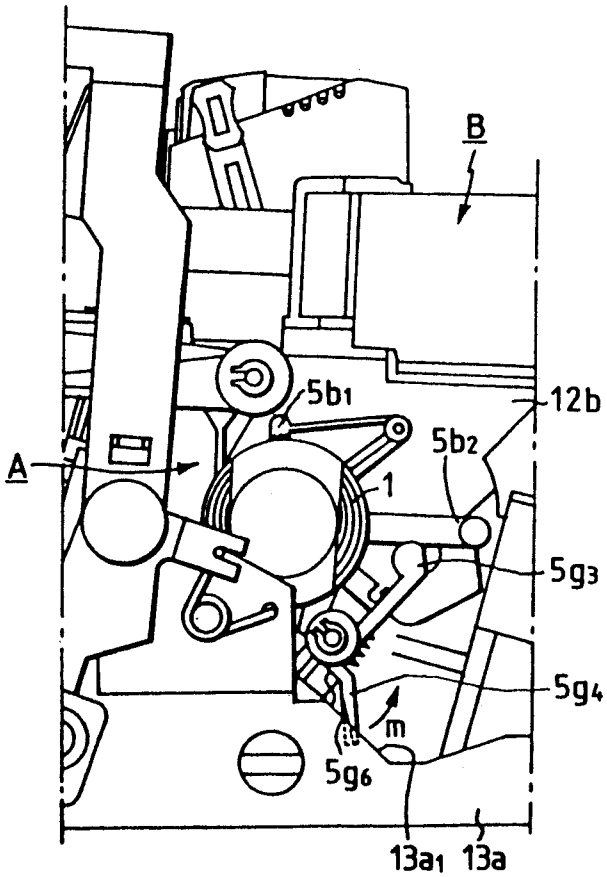

Due to the rotational force applied in the direction of arrow m, the engagement between the interlock projection $5g_5$ and the interlock recess $5b_4$ which retains the lock released state (see FIG. 2B) is forcedly disengaged, so that the lock lever 5g is automatically locked with a tensile force of tension spring 5c, as shown in FIG. 8B.

Accordingly, the lock lever 5g can be automatically locked with the initial operation of the carriage 12b, even if it might be placed in the lock released state.

SUPPORT FRAME BODY AND ADAPTOR STOPPING MEANS

The support frame body 4 is integrally formed with spool support members 4g, 4h on both ends of a connecting portion 4f, wherein one support member 4g has a supply spool 2b mounted thereon, and the other support member 4h has a take-up spool 3 mounted thereon. And a correcting ribbon drawn out from the supply spool 2b to the take-up spool 3 is set to extend between guide rollers $4d_2$, $4d_3$.

On upper portions of both support members 4g, 4h, adaptor stopping means 6 are provided. The adaptor stopping means 6 include interlock hooks 6a protruding from the support member 4g, 4h, so as to engage interlock recesses of ribbon cassette B as will be described later. Also on upper portions of the hooks 6a, presser plates 6b useful in attaching the ribbon adaptor A to the ribbon cassette B are provided. Further, on upper portions of front faces for the support members 4g, 4h are provided snap-on plates 6c.

RIBBON CASSETTE

The ribbon cassette B will be described in the following.

CASSETTE BODY

The ribbon cassette B receives an ink ribbon 7 as shown in FIG. 1, including arm portions 8a, 8b protruding therefrom on both sides of cassette case 8. Within the case 8, a supply core 8c and a take-up core 8d are rotatably received, with the ink ribbon 7 being wound around both cores 8c, 8d.

The ink ribbon 7 is formed by applying ink onto a strip like support film. And the ink ribbon 7 drawn out from the supply core 8 is exposed from an opening portion 8e on a top end of arm 8a, guided with a guide face 8f mounted on an extreme end of arm portion, further guided with a guide face 8g mounted on an extreme end of arm 8b on the other side, returned through an opening portion on a top end of arm 8b into the cassette case 8, and received to be wound around the take-up core 8d.

ADAPTOR ATTACHMENT MEANS

Figure 9:
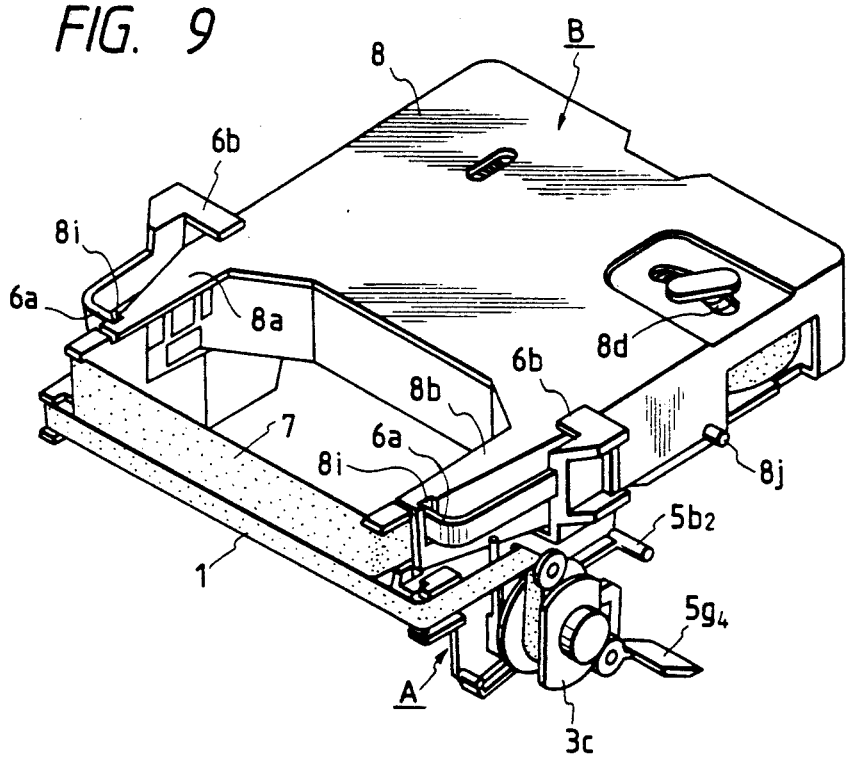
FIG. 9 is a perspective explanation view showing a state where a ribbon adaptor is attached onto a ribbon cassette.

On top end outer sides of the arm portion 8a, 8b, interlock recesses 8i that are adaptor attachment means are provided. The interlock recesses 8i are engaged by the interlock hooks 6a of ribbon adaptor A, as shown in FIG. 9, when the ribbon adaptor A is attached to the ribbon cassette B as previously described.

As previously described, if the ribbon adaptor A is attached to the ribbon cassette B with the interlock hooks 6a engaging the interlock recesses 8i, the presser plates 6b and connecting portion 4f of the ribbon adaptor A serve to carry the cassette case 8 on the upper and lower surfaces thereof and prevent slippage in the upward or downward direction. Also, the snap-on plates 6c serve to prevent the slippage in the left or right direction thereof by pressing on the outer walls on the opening portions 8e, 8h of arms 8a, 8b inserted therebetween. Thereby, the ribbon adaptor A can be attached to the ribbon cassette B without slippage.

Figure 10:
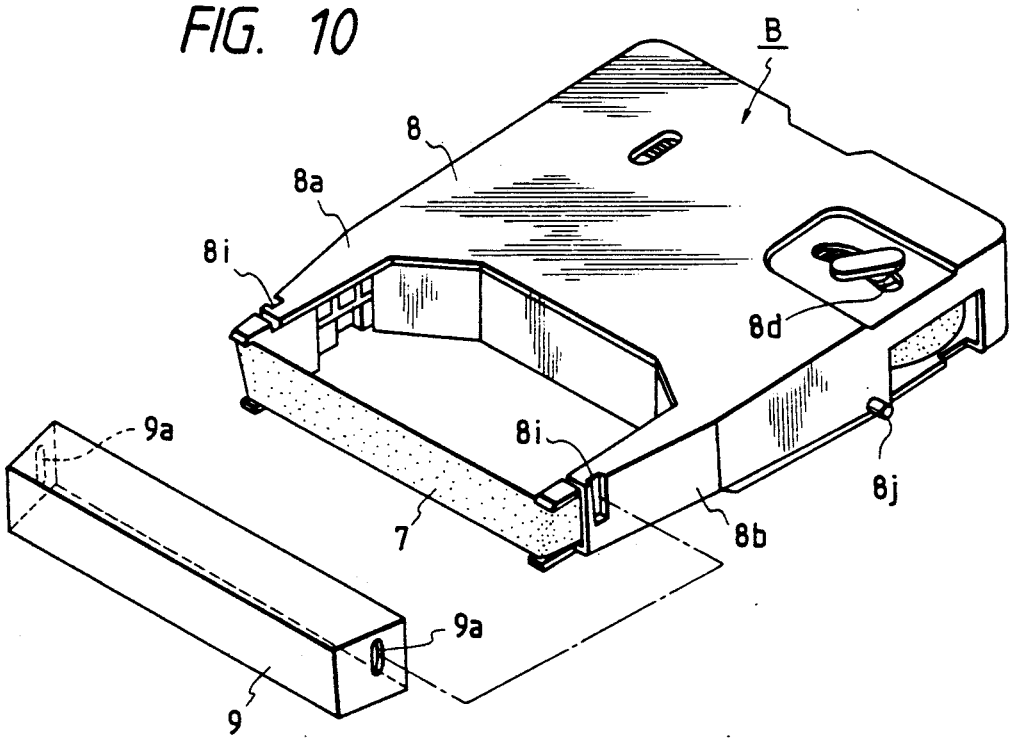
FIG. 10 is a perspective explanation view showing the attachment of a protection cover onto the ribbon cassette.

In the ribbon cassette B, the ink ribbon 7, which is extended between guide faces 8f, 8g, is easily subject to damage on an exposed portion, or may cause an ink stain due to contact with other portions. Thus in this example, a protection cover 9 can be attached to a top end portion of arm for the ribbon cassette B, as shown in FIG. 10. The protection cover 9 is provided with projections 9a projecting into inner faces on both sides, wherein when the cover 9 is attached to the arm top portion, the projections 9a are fitted and secured into the interlock recesses 8i of ribbon cassette B. Accordingly, the ink ribbon 7 can be protected from the spoilage and ink stain by covering an exposed ink ribbon with the protection cover 9 attached to the arm top end, when the ribbon cassette B is not used.

As previously described, in the ribbon cassette B of this example, the ribbon adaptor A as well as the protection cover 9 can be attached by the use of the interlock recesses 8i provided on top end portions of arm portions 8a, 8b.

ENGAGING MEANS

The ribbon cassette B is to be attached to a recording apparatus C as will be described, wherein interlock projections 8j that are engaging means are provided to protrude substantially from a central portion on both sides of cassette case 8.

RECORDING APPARATUS

A constitution of the recording apparatus for recording with the ribbon cassette B mounted therein will be described in the following.

Note that in the following example, the winding of ink ribbon and delivering of ribbon from the ribbon adaptor are made with a driving force from the same driving source. Thereby, the number of parts such as a motor can be reduced.

Figure 11:
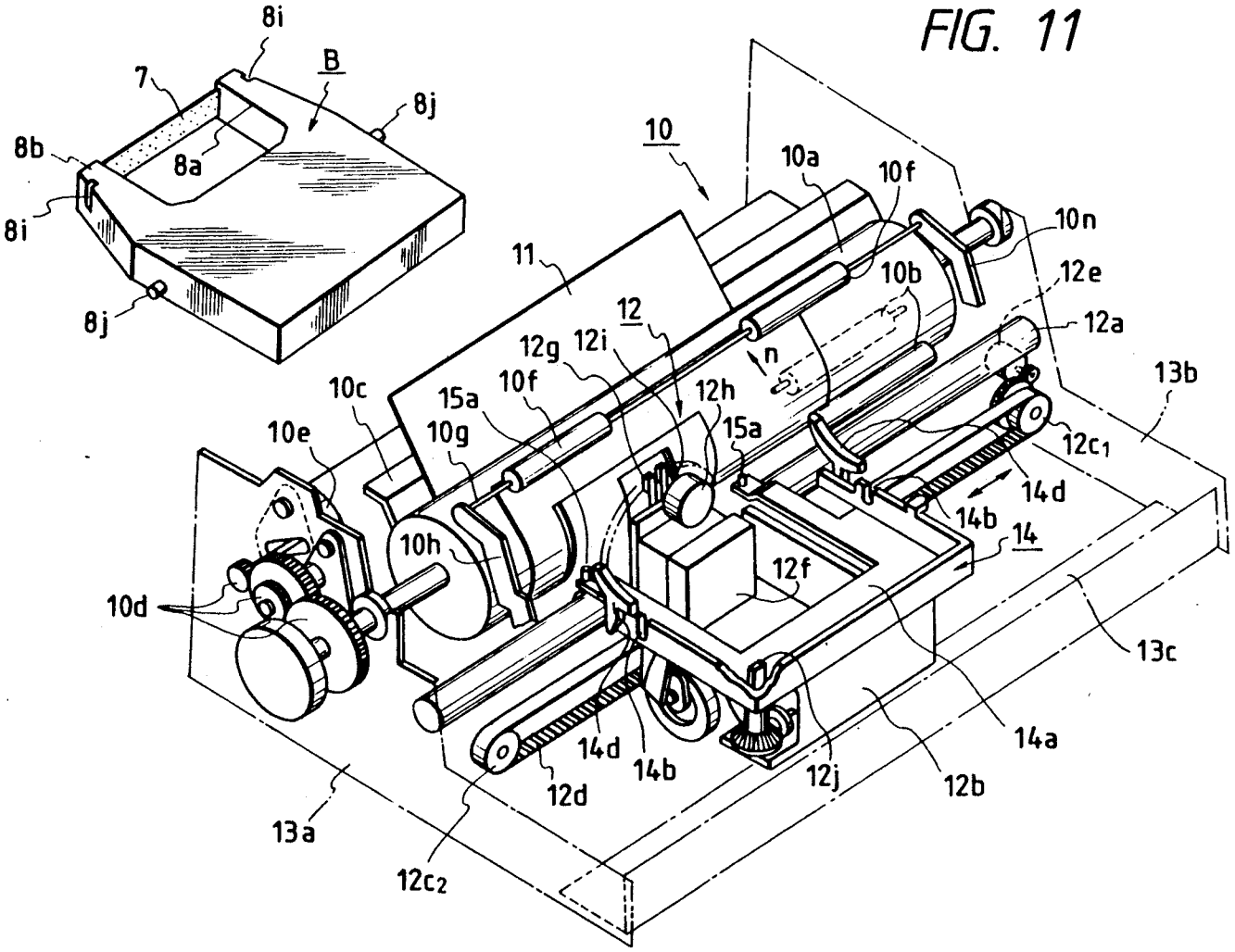
FIG. 11 is an explanation view showing a constitution of a recording apparatus.

The recording apparatus C records onto a recording sheet 11 conveyed by sheet conveying means 10 using recording means 12, as shown in FIG. 11, wherein the recording means 12 of this example records by rotating a daisy wheel type element.

RECORDING MEANS

The recording means 12 includes a carriage 12b slidably mounted on a guide rail 12a with its both ends secured to left and right frames 13a, 13b, the carriage 12b being mounted to be reciprocatingly movable along the guide rail 12a and a frame end 13c thereof. Also, in the vicinity of both ends of the guide rail 12a, a driving pulley $12c_1$ and a driven pulley $12c_2$ are mounted, and between both pulleys $12c_1$, $12c_2$ is extended a timing belt 12d a part of which is connected to the carriage 12b. Accordingly, the carriage 12b can reciprocate along the guide rail 12a by driving a carriage motor 12e connected to the driving pulley $12c_1$ in forward and reverse directions.

Also, on the carriage 12b are mounted a character wheel 12g rotatable by a wheel motor 12f, and a hammer 12i driven by a solenoid 12h. Further, on the carriage 12b is provided cassette mounting means 14 for mounting of the ribbon cassette B as above described, wherein if the ribbon cassette B is mounted to the cassette mounting means 14, a winding reel 12j is connected into a winding core 8d. And as previously described (see FIG. 4C), if the ribbon motor 5f$_1$ is driven in a forward direction, the driving force of motor 5f$_1$ is transmitted via a ribbon gear 12k to the winding reel 12j, thereby causing the winding core 8d to be rotated, so that the ink ribbon 7 is drawn out from the supply core 8c, and wound around the winding core 8d.

The recording means 12 is one in which in recording, the carriage 12b is moved to a recording position, and the character wheel 12g is rotated to confront a desired character to the hammer 12i, which is then driven to hit a back face of the character, whereby printing is performed by transcribing ink of the ink ribbon 7 onto a recording sheet 11. In this way, if one character has been printed, the carriage 12b is moved to a next print position for the next printing. And if one line of print has been terminated, the recording sheet 1 is conveyed one line with sheet conveying means 10 to print a next line in the same way.

SHEET CONVEYING MEANS

The sheet conveying means 10 performs the conveyance for feeding a recording sheet 11 to a recording position, and exhausting the recorded sheet 11 after recording.

The sheet conveying means 10 of this example includes a platen roller 10a provided parallel to the guide rail 9, pressed thereon by a driven rotatable (follower) pinch roller 10b, and having a paper pan 10c along a periphery of the platen roller 10a, as shown in FIG. 11. And it includes a conveying motor 10e connected via a drive transmission gear 10d to the platen roller 10a.

Accordingly, if the conveying motor 10e is driven, the platen roller 10a is rotated, wherein a recording sheet 11 is conveyed along a periphery of platen roller 10a owing to its cooperative action with the pinch roller 10b, and passing between the platen roller 10a and the ink ribbon 7, in a direction of arrow n as indicated in FIG. 11.

Note that a sheet presser roller 10f is provided to prevent the recording sheet 11 from lifting up from a surface of the platen roller for the conveyance as above described. And the sheet presser roller 10f has both ends of roller axle 10g supported in a support arm 10h, which can be swung so as to be separated away from the platen roller 10a when a sheet is set.

CASSETTE MOUNTING MEANS

Figure 12:
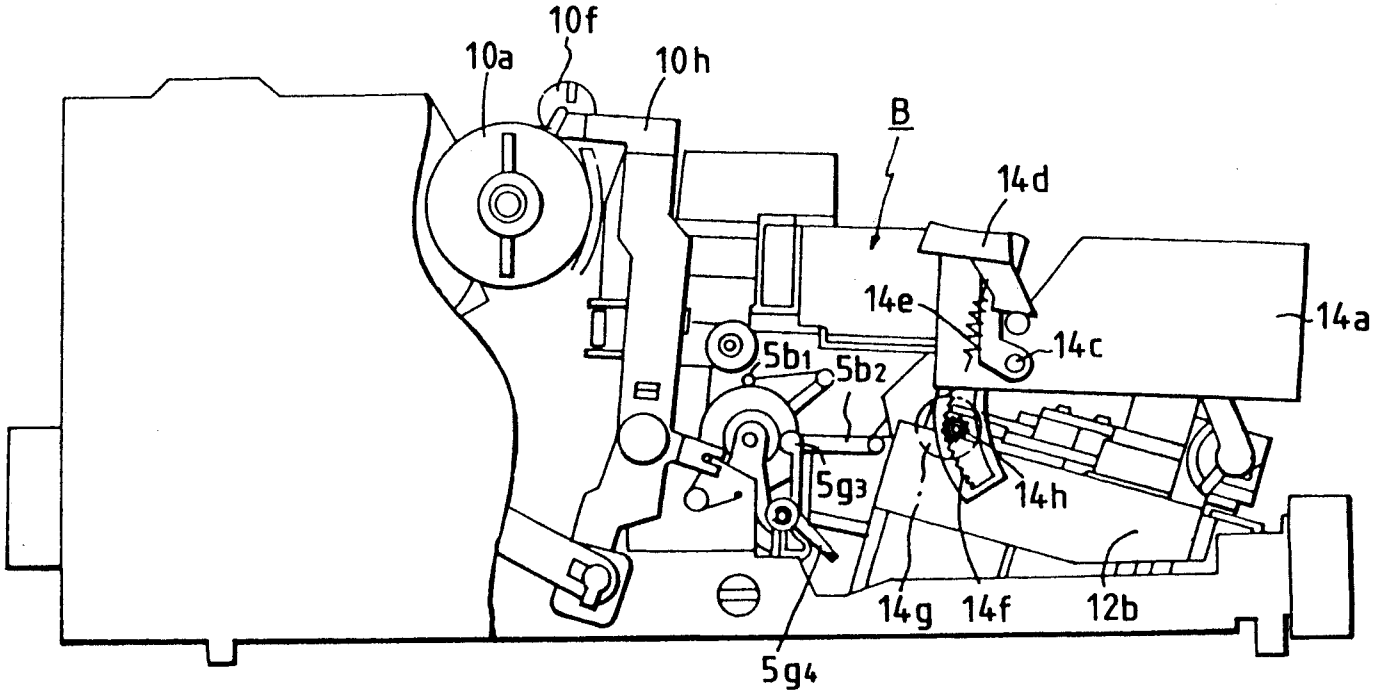
FIG. 12 is a cross-sectional explanation view of a state where the ribbon cassette is attached to the carriage.

The cassette mounting means 14 includes a cassette table 14a mounted on the carriage 12b, the cassette table 14a being provided on its both sides with notches 14b into which the interlock projections 8j of ribbon cassette B are fitted and secured, as shown in FIGS. 11 and 12. Also, in the vicinity of the notches 14b are provided hooks 14d rotatable around hook axles 14c, the hooks 14d being urged by tension springs 14e.

Accordingly, the ribbon cassette B is mounted to the cassette table 14a by fitting the interlock projections 8j of ribbon cassette B into the notches 14b, and pressing down the interlock projections 8j with the hooks 14d for securing, as shown in FIG. 12.

The cassette table 14a is mounted rotatably around a shaft on the carriage 12b, in which a rack type shift gear 14f provided on a lower portion of cassette table 14a mates with an output gear of shift motor 14g mounted on the carriage 12b, as shown in FIG. 12. Thereby, if the shift motor 14g is driven, the cassette table 14a is rotated, so that the ribbon cassette B mounted to the cassette table 14a can be moved up and down.

Figure 13A:
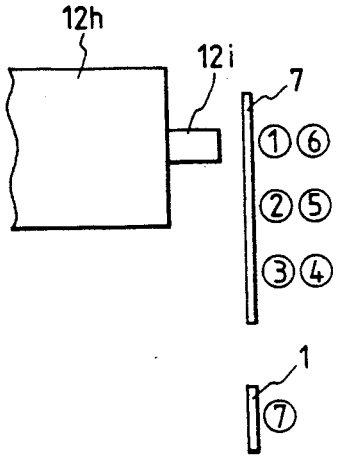
FIGS. 13A and 13B are explanation views showing the shifting of a ribbon cassette.
Figure 13B:
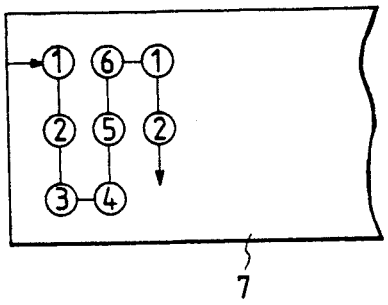

In recording, the shift motor 14g and the ribbon motor 5f$_1$ are driven to print three characters at a time in a width direction of the ink ribbon 7, as shown in FIG. 13A and 13B. That is, as shown in FIG. 13B, the ribbon cassette B is shifted to print three characters (①, ②, ③) from up to down in the width direction of the ink ribbon 7, and then, for the next printing, the ribbon motor 5f$_1$ is driven to wind the ink ribbon 7 by the amount of one character, and the ribbon cassette B is shifted to print three characters (④, ⑤, ⑥) from down to up in the width direction of the ink ribbon 7. Thus, printing of three characters at a time in the width direction of ribbon allows the effective use of the ink ribbon 7.

When a misprint is to be corrected using the correcting ribbon 1, the ribbon cassette B is shifted so that the correcting ribbon 1 as shown in FIG. 13A is opposed to the hammer 12i. That is, if the ribbon adaptor A is attached to the ribbon cassette B, the correcting ribbon 1 is located downward of the ink ribbon 7, as shown in FIG. 9. Accordingly, when the misprint is corrected, the shift motor 14g is driven to shift upward a top end of ribbon cassette B so that the position of correcting ribbon 1 (position ⑦ in FIG. 13A) is opposed to the hammer 12i, and that correcting ribbon 1 must be hit with a desired character. That is, the deletion and, correction can be achieved by letting the misrecorded image deposit on the correcting ribbon 1 and peeling it off of the recording sheet (so-called a lift-off, correction). Note that the correction can also be achieved by simply covering the misrecorded image with ink of the correcting ribbon (so-called a cover wrap correction).

ADAPTOR POSITIONING MEANS

In this example, a feed lever 5b for feeding the correcting ribbon 1 is provided on the ribbon adaptor A, and a correction cam 5efor operating the feed lever 5b is provided on the carriage 12b, wherein the ribbon adaptor A is constituted to be detachable from the carriage 12b. Therefore, adaptor positioning means is provided to ensure that the relative position between the feed lever 5b and the correction cam 5e can be maintained constant at all times when the ribbon adaptor A is attached.

Figure 14A:
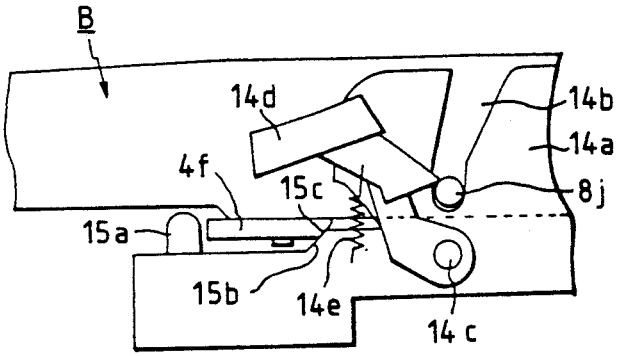
FIGS. 14A and 14B are explanation views showing the positioning of the ribbon adaptor on a cassette table.
Figure 14B:
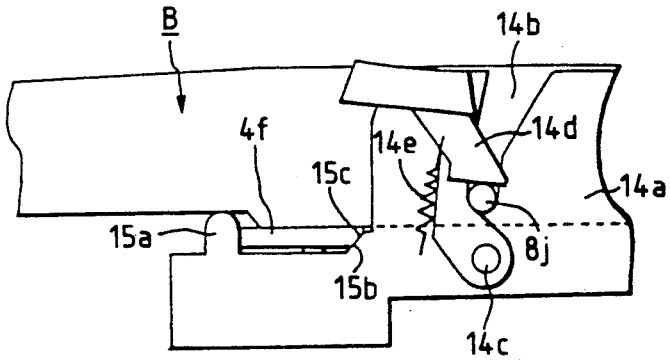

The constitution of positioning means is such that when the ribbon cassette B having the ribbon adaptor A attached thereto is mounted on the cassette table 14a, the connecting portion 4f of ribbon adaptor A is positioned on a front portion of cassette table 14a, as shown in FIGS. 14A and 14B. In this example, stopper projections 15a are provided on the front portion of cassette table 14a, and slant portions 15b are correspondingly provided at positions where each slant portion is separated away by the width of connecting portion 4f of ribbon adaptor A from each of the projections 15a, as shown in FIGS. 11, 14A and 14B. Also, on a back portion of the connecting portion 4f are provided slant portions 15c to be correspondingly coincident with the slant portions 15b. Accordingly, if the ribbon cassette B having the ribbon adaptor A attached thereto is mounted on the cassette table 14a, the slant portions 15c of connecting portion 4f are brought into contact with the slant portions 15b of cassette table 14a, as shown in FIG. 14A. In this state, if the interlock projections 8j of ribbon cassette B are forced into the notches 14b with the hooks 14d, the connecting portion 4f is forced forward along the slant faces 15*b*, and a front end of connecting portion 4*f* is made to contact the stopper projections 15*a*, as shown in FIG. 14B. Thereby, positioning of the ribbon adaptor A can be achieved in the forward or backward directions. Upper and lower surfaces of the connecting portion 4*f* are sandwiched between a lower surface of ribbon cassette B and an upper surface of cassette table 14*a*, thereby allowing the positioning in an upward of downward direction.

Accordingly, since the ribbon adaptor A is securely positioned and fixed on the carriage 12*b*, driving of the correction cam 5*e* allows the feed lever 5*b* of ribbon adaptor A to be reliably operated. The positional relation of both members 5*b*, 5*e* are not affected by the attachment of ribbon adaptor A and ribbon cassette B, or the detachment thereof.

CONTROL MEANS

A control system for controlling the driving of each member as above described will be explained in the following.

Figure 15:
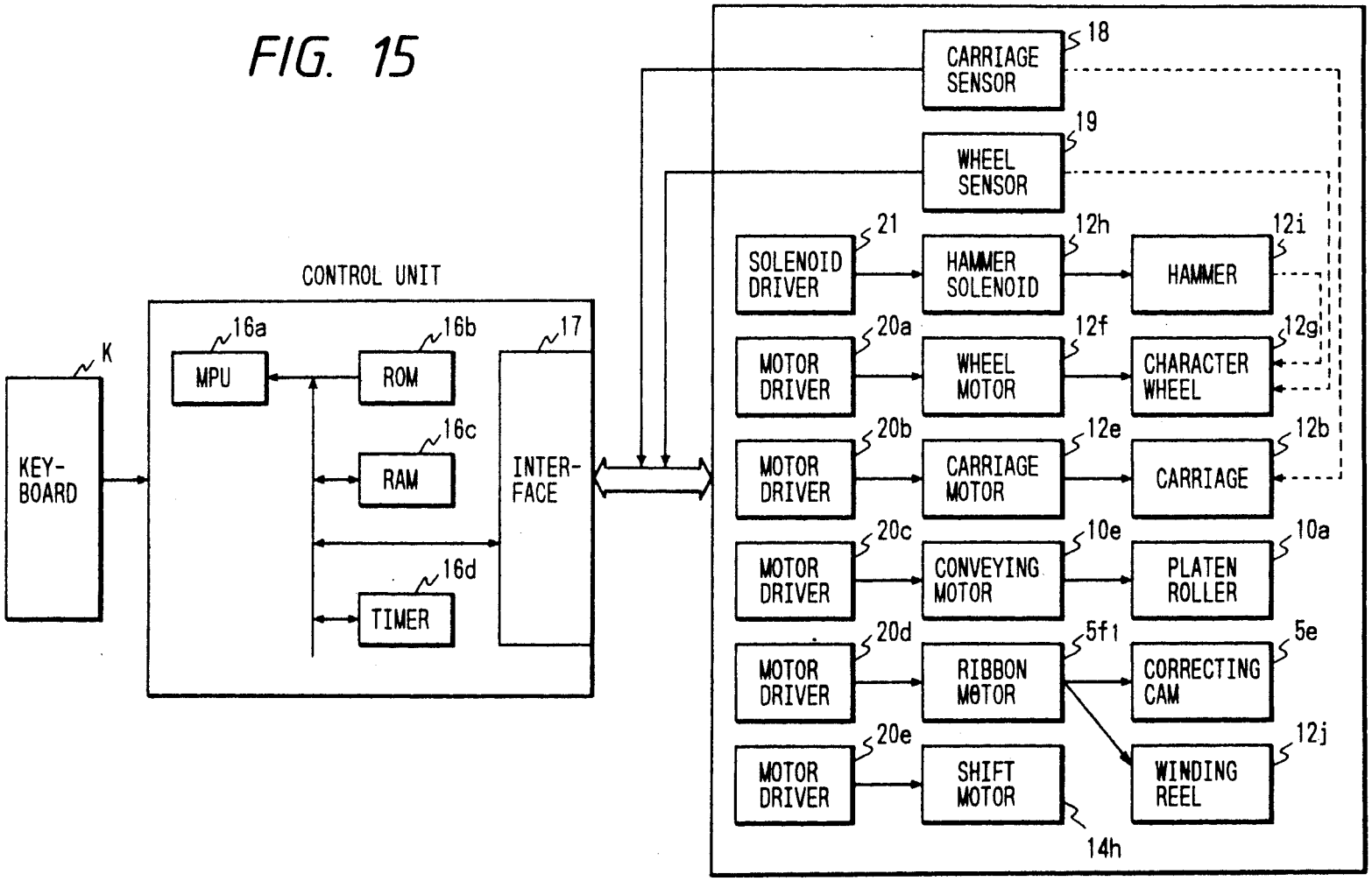
FIG. 15 is a block diagram of control system.

In FIG. 15, 16 is a control section, consisting of MPU 16*a*, ROM 16*b*, RAM 16*c* and timer 16d*d*.

The MPU 16*a* is a central processing unit for performing the operations such as input of programs from ROM 16*b* or input from a keyboard K, reading of various data, execution of necessary operations or judgements, and various controls.

ROM 16*b* is a read-only memory, in which various programs for operation of MPU 16*a* and various data necessary for recording are stored.

RAM 16*c* is a random access memory, which is composed of a working area for temporarily storing data or operation results being executed by MPU 16*a*, a buffer area for storing various data input from the keyboard K, and a text area for storing documents or the like.

The timer 16*d* is provided to administer the driving time of each motor.

The control section 16*d* has inputs of signals via an interface 17 from the keyboard K, and detection signals from a carriage sensor 18 for detecting the left end of movement range for the carriage 12*b* or a wheel sensor 19 for detecting a home position of character wheel 12*g*. And the control section 16 outputs driving signals to a wheel motor 12*f*, a carriage motor 12*e*, a conveying motor 10*e*, a ribbon motor $5f_1$, further, motor drivers 20*a*, 20*b*, 20*c*, 20*d*, 20*e* for driving a shift motor 14*g*, and a solenoid driver 21 for driving a hammer solenoid 12*h*.

Figures 1, 16C:
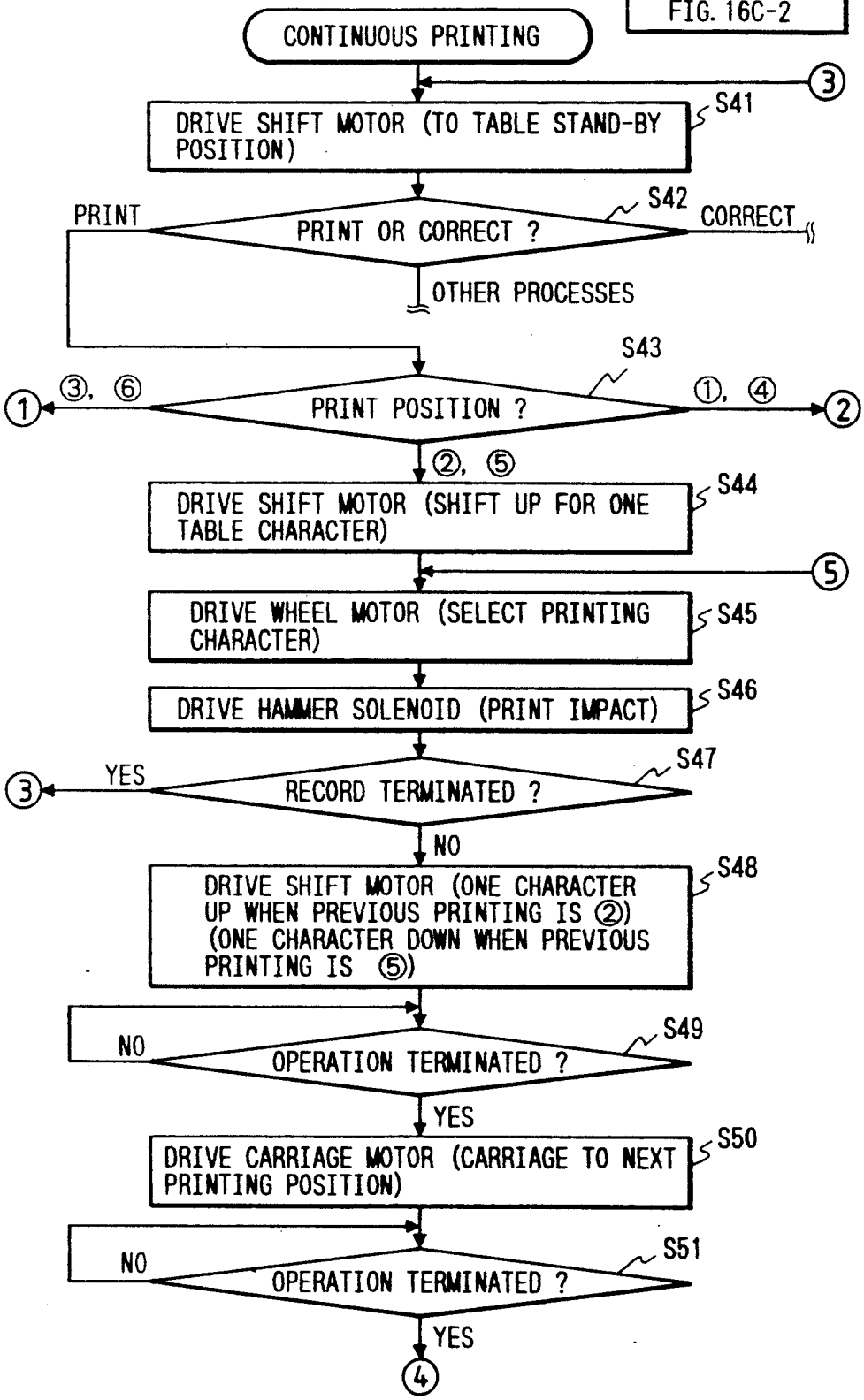

Referring now to flowcharts of FIGS. 16A–16C, a control procedure for the print and correction will be described, in which the ribbon cassette B attached to the ribbon adaptor A is mounted on the recording apparatus C.

FIG. 16A is a flowchart showing the initial operation of recording apparatus C. First, at step S1, the power is turned on, and then proceeding to steps S2–S4, the carriage motor 12*e* is driven until the carriage sensor 18 is turned on, so that the carriage 12*b* is moved to the left end as shown in FIG. 11. Thereby, even if the lock lever 5*g* of ribbon adaptor A is in a lock released state, it will be automatically locked, as previously described.

Next, proceeding to step S5, the shift motor 14*g* is driven by a predetermined amount to turn the cassette table 14*a* down, and at step S6, the ribbon motor $5f_1$ is driven in a forward direction to wind ink ribbon 7 by a predetermined amount. Further, proceeding to steps S7–S9, the wheel motor 12*f* is driven until the wheel sensor 19 is turned on, so that the home position of character wheel 12*g* is opposed to the hammer 12*i*. And proceeding to step S10, the carriage motor 12*e* is driven by a predetermined amount, so that the carriage 12*b* is moved from a leftmost end to the right by a predetermined amount up to a record reference position. Thereby, the procedure is in a record stand-by state.

Referring now to a flowchart of FIG. 16B, the printing and misprint correcting operation procedure will be described. Note that the printing procedure as shown in this flowchart represents a case of one character print.

If a print or correction signal, or other processing signal is entered in the record stand-by state, the input signal is judged at step S11, in which the routine proceeds to step S12 if printing, or it proceeds to step S20 if correcting, or otherwise to step S37.

If a print signal is input at step S11, the routine proceeds to step S12, where the wheel motor 12*f* is driven to oppose a desired character of character wheel 12*g* to the hammer 12*i*. Then, proceeding to steps S13 and S14, the shift motor 14*g* is driven to shift up the cassette table 14*a* and thereby shift the ink ribbon 7 to a position opposed to the selected character as previously indicated.

Next, proceeding to step S15, the ribbon motor $5f_1$ is driven in a forward direction to wind the ink ribbon 1 by a predetermined amount, and then at step S16, the hammer solenoid 12*h* is driven to hit the selected character with the hammer 12*i*, so that ink of the ink ribbon 7 is transcribed and printed to a recording sheet 11. After printing, the routine proceeds to steps S17–S19, where the cassette table 14*a* is shifted down, and the carriage 12*b* is moved to a next printing position, and then, the routine returns to step S11 to wait for a next print signal.

On the other hand, if a correct signal is input at step S11, the routine proceeds to step S20, where the wheel motor 12*f* is driven to oppose a correcting character to the hammer 12*i*, and at step S21, the carriage 12*e* is driven to move the carriage 12*b* to a position of correcting character. And proceeding to steps S22 and S23, the shift motor 14*g* is driven to shift up the cassette table 14*a* so that the correcting ribbon 1 is opposed to the selected character (i.e., to a position where ⑦ in FIG. 13A is opposed to the hammer 12*i*).

Next, proceeding to steps S24 and S25, the ribbon motor $5f_1$ is driven in a reverse direction to project the correcting cam 5*e* in a direction of arrow e, so that the cam face $5e_1$ is contacted by the lever portion $5b_2$ of feed lever 5*b*, which is thereby forced up to feed the correcting ribbon 1 by a predetermined amount, as shown in FIG. 3B.

Next, proceeding to step S26, the hammer solenoid 12*i* is driven to perform a correcting impact to hit the correcting ribbon 1 at the selected character. Thereby, the misprinted ink adheres to the correcting ribbon 1, and peeled is off of the recording sheet 11 (so-called a lift off correction). In this example, after the misprint portion is hit with the correcting ribbon 1 as previously described, the correction impact operations are performed twice in such a manner that as shown in steps S27–S32, the shift motor 14*g* is driven in forward and backward directions to move the cassette table 14*a* up and down, thereby feeding the correcting ribbon 1 by a predetermined amount, and the carriage motor 12*e* is driven to move the carriage 12*b* by a small amount, and then hits the correcting ribbon 1 with the hammer 12*i*. Thereby, misprint ink onto the recording sheet 11 can be completely peeled off the sheet 11.

After the misprinted ink has been peeled off of the recording sheet 11 as above described, at step S33, the ribbon motor $5f_1$ is driven in a forward direction to return the correction cam 5e to a stand-by position, and at steps S34–S36, the cassette table 14a is shifted down and the carriage 12b is returned to a stand-by position where it is possible to print onto a corrected character position.

At step S11, if a processing signal other than print or correct signal as above described, for example, a sheet conveying signal, has been input, the routine proceeds to step S37, where other processes corresponding to the processing signal are performed. Note that since the sheet conveying procedure is made using well-known means, the explanation thereof will be omitted.

Referring now to a flowchart of FIG. 16C, the printing procedure in which a print signal indicates the continuous print will be described.

If it is judged that a print signal has been input at step S42, as previously described, the print position of ink ribbon 7 is decided at step S43. And among the print positions 1–6 in FIG. 13B, the routine jumps to step S58 if ① or ④, or to step S52 if ③ or ⑥, or to step S44 if ② or ④.

For example, if the print position is a position ② in FIG. 13B, the routine proceeds to step S44, where the shift motor 14g is driven to shift up the cassette table 14a so as to be printable at the position ②. Thereby, the position as indicated in FIG. 13A to which the hammer 12i is opposed is the position ② of ink ribbon 7.

Next, proceeding to steps S45 and S46, the character wheel 12g is rotated to oppose a desired character to the hammer 12i, and print by hitting the character with the hammer 12i.

After printing, a determination is made whether or not next print exists, and if not, the routine returns to step S41, where the cassette table 14a is shifted down to a stand-by position. On the contrary, if next print exists, the routine proceeds to steps S48 and S49, where the cassette table 14a is shifted up for one character. Thereby, the position as indicated in FIG. 13A to which the hammer 12i is opposed is a position ③ of ink ribbon 7 (when previous print position at step S46 is a position 5 in FIG. 13B, the cassette table 14a is shifted down for one character at step S48, to oppose the hammer 12i to a position ⑥).

At steps S50–S53, the carriage 12b is moved to the next printing position to oppose a desired character to the hammer 12i, and printing is done hitting the character with the hammer 12i.

Next, a decision is made whether or not next print exists, at step S54, in which if record is terminated, the routine returns to step S41, and if next print exists, the routine proceeds to steps S55 and S56, where the carriage 12b is moved to the next printing position. And at step S57, the ribbon motor $5f_1$ is driven in a forward direction to wind the ink ribbon 7 for one character. Thereby, the position of ink ribbon 7 to which the hammer 12i is opposed is a position in FIG. 13B (when previous printing position at step S53 is a position ⑥ of FIG. 13B, it becomes ①). And proceeding to steps S58 and S59, a desired character is selected and printed.

Further, if next print exists at step S60, the routine proceeds to steps S61 and S62, where the cassette table 14a is shifted up for one character. Thereby, the position of ink ribbon 7 in FIG. 13A to which the hammer 12i is opposed is a position ⑤ (when previous printing position at step S46 is a position 1 in FIG. 13B, the cassette table 14a is shifted down one character at step S48, to oppose a position ② to the hammer 12i).

Next, at steps S63 and S64, the carriage 12b is moved to a next printing position, and the routine returns to step S45.

By shifting the cassette table 14a as above described, printing is achieved for three characters at a time in the width direction of ink ribbon 7 as shown in FIG. 13B.

In this way, the printing can be achieved onto a recording sheet 11, and the correcting of misprinted characters can be made with the ribbon adaptor A attached to the ribbon cassette B.

The ribbon adaptor A can be easily attached to the ribbon cassette B. And even if the ribbon adaptor A is attached to the ribbon cassette B in a lock released state, it can be automatically locked by initiating the carriage 12b, in which the correction cam 5e for feeding the correcting ribbon 1 can be operated by the ribbon motor $5f_1$ for winding the ink ribbon 7.

SECOND EXAMPLE

Figure 17A:
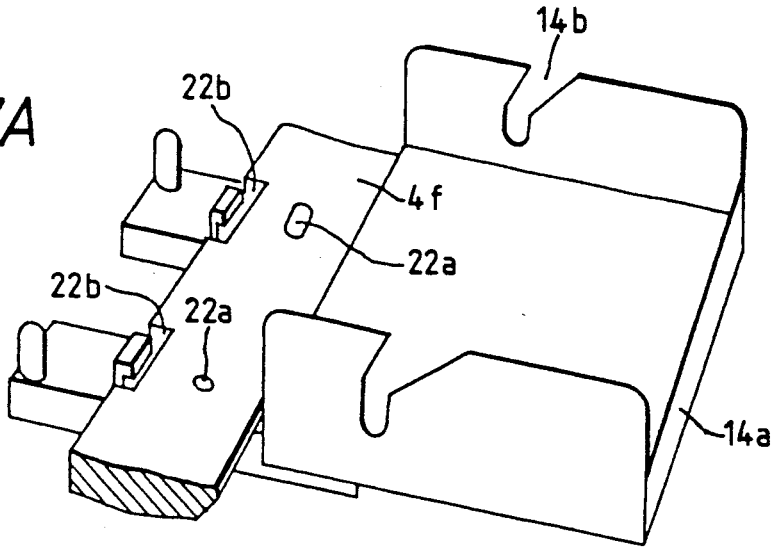
FIGS. 17A and 17B are explanation views showing a second example in which the ribbon adaptor is directly attached to the cassette table.
Figure 17B:
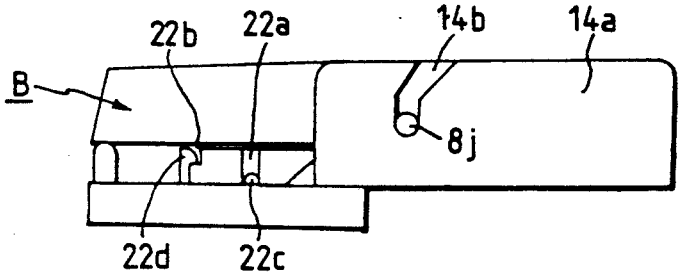

While in the first example as previously described, the ribbon cassette B having the ribbon adaptor A attached thereto is mounted on the recording apparatus C, in a second example, a ribbon adaptor A is directly mounted on the recording apparatus C, as shown in FIGS. 17A and 17B. Note that parts with the same features as in the first example are provided with the same reference numerals, and so the explanation will be omitted.

A connecting portion 4f of ribbon cassette A has positioning apertures 22a punched at predetermined positions, and interlock recesses 22b provided on a front portion thereof. On the front portion of cassette table 14a, positioning bosses 22c which fit into the positioning apertures 22a are protruded, and interlock clicks 22d which are engaged by the interlock recesses 22b are provided.

Accordingly, by mounting the ribbon adaptor A so that the connecting portion 4f of ribbon adaptor A may engage the bosses 22c and interlock clicks 22d, the ribbon adaptor A can be directly mounted on the cassette table 14a.

Note that when the ribbon adaptor A is only used, the ribbon cassette B does not have to be mounted, while if the ribbon cassette B is mounted as shown in FIG. 17B, upper and lower surfaces of connecting portion 4f of ribbon adaptor A are secured so that positioning of the ribbon adaptor A on the cassette table 14a is accomplished more reliably.

THIRD EXAMPLE

Figure 18:
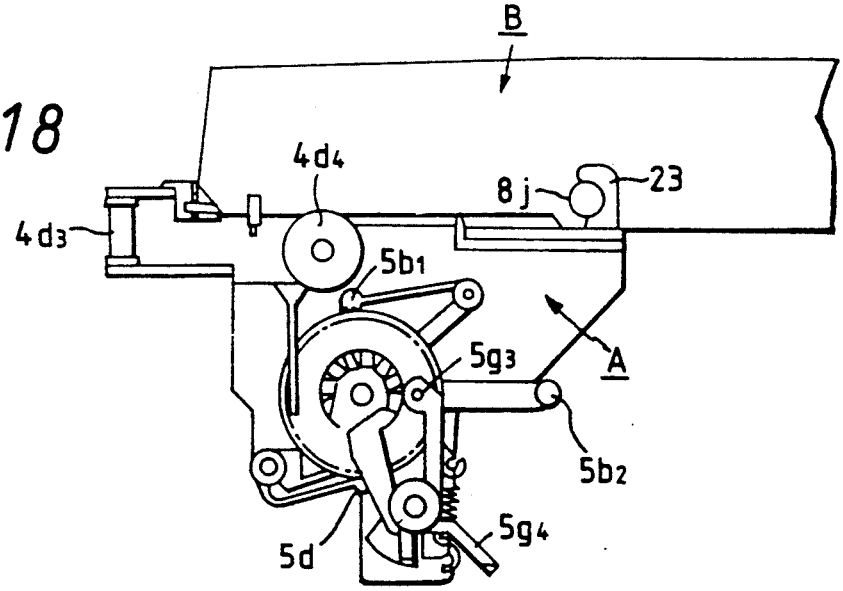
FIG. 18 is an explanation view showing a third example in which adaptor attachment means and engaging means are commonly used.

While in the first example as previously described, the interlock hooks 6a of ribbon adaptor A engage the interlock recesses 8i which constitute adaptor attachment means of ribbon cassette B, in a third example, adaptor attachment means is also used as engaging means for a ribbon cassette B, as shown in FIG. 18.

In FIG. 18, spool support members 4g, 4h of ribbon adaptor A are provided with interlock hook portions 23, which are engaged by interlock projections 8j that are engaging means for the ribbon cassette B.

In this example, after the ribbon adaptor A has been attached on the ribbon cassette B with the interlock hook portions 23 engaged by the interlock projections 8j, the cassette B can be mounted on a recording apparatus C by fitting the interlock projections 8j into notches 14b of the cassette table 14a.

With such a constitution, the interlock hooks 6a of ribbon adaptor A as in the first example become unnecessary, and the interlock recesses 8i of ribbon cassette B are also unnecessary.

OTHER EXAMPLES

In previous example, the cassette table 14a is shifted up and down to feed the correcting ribbon 1, but the lever portion 5b$_2$ can be moved up and down by reciprocating the correction cam 5e, as shown in FIGS. 3A and 3B, with the cassette table 14a left unchanged.

Also, in previous example, the operation of correction cam 5e and the winding of ink ribbon 7 are performed by driving the same motor in forward and reverse directions, but they can be of course fulfilled with separate motors.

Further, in the previous example, the correcting ribbon 1 is one which peels off ink transcribed onto a recording sheet 11, but other ribbons can also be used in which the misprint is corrected by transferring correction ink of the same color as that of the recording sheet 11 onto the misprint.

Further, in the previous example, the correcting ribbon, 1 is attached to a ribbon adaptor A for correction of the misprint, but an ink ribbon (e.g. red) of different color from an ink ribbon (e.g. black) of ribbon cassette B is attached to the adaptor A, and the printing can be performed with two colors, using the ink ribbon of ribbon cassette B in normal printing, or the ink ribbon of ink adaptor A as required.

Also, in previous example, an example of recording apparatus is illustrated using an electronic typewriter, but a recording apparatus using a ribbon adaptor A and a ribbon cassette B according to the present invention is not limited to the electronic typewriter. Accordingly, recording means is not limited to a method of recording with the rotation of a daisy wheel as previously described, but the wire dot recording or thermal transfer recording method can also be used.

Further, in the previous example, conveying means of recording sheet 11 is a platen roller 10a which is also used as a platen, but a roller other than the platen can be used, or a rotational belt, for example, rather than roller type can be also used.

As detailed hereinbefore, a ribbon adaptor is provided with ribbon feed means, and constructed to be attached to a ribbon cassette or recording apparatus. Thereby, it is possible to easily accomplish the attachment of the ribbon adaptor to the recording apparatus, or correction of the misprint with the correcting ribbon.

If attachment means of the ribbon adaptor is constituted to use that of a protection cover attachable to the ribbon cassette, attachment of the correcting ribbon can be realized without increasing the manufacturing, cost because of a simpler construction of the ribbon cassette.

Further, according to another aspect of the present invention, winding of an ink ribbon and feeding of a ribbon from a ribbon adaptor are performed using the driving force from the same driving source, so that the number of motor parts can be reduced, thereby permitting the decrease of cost and miniaturization of the apparatus.

Moreover, according to another aspect of the present invention, abutting portions are provided on a part of the lock means for the ribbon adaptor, so that if the recording apparatus is operated in a lock released state, the abutting portion are caused to abut on other members, thereby causing lock means to be automatically locked, and thus, even if the lock is forgotten, lock means can be automatically locked to avoid ribbon dislocation or misprint.

We claim:

1. A ribbon adaptor attachable to a recording apparatus, comprising:

ribbon loading means for loading an ink ribbon;

ribbon feed means for feeding the ribbon loaded by said ribbon loading means;

a support frame member for supporting said ribbon loading means and said ribbon feed means: and adaptor stopping means provided on said frame member.

2. A ribbon adaptor according to claim 1, wherein said adaptor stopping means is engageable with a ribbon cassette for receiving the ink ribbon.

3. A ribbon adaptor comprising:

supply means for supplying a ribbon;

winding means for winding the ribbon supplied from said supply means;

a support frame member for rotatably supporting said supply means and said winding means;

ribbon feed means for feeding the ribbon from said supply means to said winding means; and adaptor stopping means provided on said support frame member.

4. A ribbon adaptor according to claim 3, wherein the ribbon is either a correcting ribbon for erasing misprinted characters or an ink ribbon for recording.

5. A ribbon cassette attachable to a recording apparatus, comprising:

a cassette main body for supporting an ink ribbon; and adaptor attachment means which engages adaptor stopping means for a ribbon adaptor, said ribbon adaptor having ribbon loading means for loading the ink ribbon, ribbon feed means for feeding the ribbon loaded by said ribbon loading means, a frame member for supporting said ribbon loading means and said ribbon feed means, and said adaptor stopping means provided on said frame member.

6. A ribbon cassette according to claim 5, further comprising engaging means for engaging a main body of the recording apparatus in attaching the cassette to the recording apparatus.

7. A ribbon cassette according to claim 5, wherein said adaptor attachment means is also used as attachment means of a protection cover for protecting the ink ribbon exposed from said cassette main body.

8. A ribbon cassette according to claim 6, wherein said adaptor attachment means is also used as said engaging means.

9. A recording apparatus for recording onto a recording medium, comprising:

attachment means for attaching of a ribbon adaptor having ribbon loading means for loading an ink ribbon, ribbon feed means for feeding the ribbon loaded by said ribbon loading means, a frame member for supporting said ribbon loading means and said ribbon feed means, and adaptor stopping means provided on said frame member;

conveying means for conveying the recording medium; and recording means for recording onto said recording medium.

10. A recording apparatus according to claim 9, wherein said recording apparatus further comprises attachment means for attachment of a ribbon cassette.

11. A recording apparatus for recording onto a recording medium, comprising:

attachment means for attachment of a ribbon cassette provided with adaptor attachment means which engages stopping means for a ribbon adaptor, said ribbon adaptor having a cassette main body for supporting an ink ribbon, ribbon loading means for loading the ink ribbon, ribbon feed means for feeding the ribbon loaded by said ribbon loading means, a frame member for supporting said ribbon loading means and said ribbon feed means, and said adaptor stopping means provided on said frame member;

conveying means for conveying the recording medium; and recording means for recording onto the recording medium.

12. A recording apparatus, comprising:

attachment means for attaching a ribbon adaptor having ribbon feed means for winding an ink ribbon from supply means to winding means, and a ribbon cassette for receiving the ink ribbon; and a common driving source for driving the operation of ribbon feed means for said ribbon adaptor, and the operation of winding the ribbon of said ribbon cassette.

13. A recording apparatus, comprising:

attachment means for attaching a ribbon adaptor having ribbon feed means for winding an ink ribbon from supply means to winding means, and a ribbon cassette for receiving the ink ribbon;

a common driving source for driving the operation of an abutting member for abutting on said ribbon feed means for said ribbon adaptor, and the operation of winding the ink ribbon of said ribbon cassette by said winding means, and said ribbon feed means is operated by reciprocating means for reciprocating said ribbon adaptor with said abutting member abutting on said ribbon feed means.

14. A recording apparatus according to claim 13, wherein the ribbon of said ribbon adaptor is wound with the reciprocating motion of said abutting member.

15. A recording apparatus according to claim 13 or 14, wherein after abutment of said abutting member and said ribbon adaptor, the ribbon of said ribbon adaptor is wound by up and down driving means for shifting said ribbon cassette and said ribbon adaptor.

16. A ribbon adaptor, comprising:

supply means for supplying a ribbon;

winding means for winding the ribbon supplied from said supply means;

a support frame member for rotatably supporting said supply means and said winding means;

lock means for locking so that said ribbon may not fall off said support frame member, and abutting portions for abutting on a part of said lock means in a lock released state to place said lock means in a lock state.

17. A ribbon adaptor for use with a printer apparatus main body, comprising:

attachment means for attaching a ribbon adaptor, said ribbon adaptor having supply means for supplying a ribbon, winding means for winding the ribbon supplied from said supply means, a support frame member for rotatably supporting said supply means and said winding means, lock means for locking so that the ribbon may not fall off said support frame member and abutting portions for abutting on a part of said lock means in a lock released state to place said lock means in a lock state; and a carriage for reciprocating recording means for recording on a recording medium in predetermined directions, wherein said abutting portions of said lock means is caused to abut on a part of the apparatus main body when said carriage reaches an extreme portion of its movement range.

18. A ribbon cassette attachable to a recording apparatus, comprising:

a cassette main body for supporting an ink ribbon;

adaptor attachment means for attachment of a ribbon adaptor; and a ribbon adaptor, said ribbon adaptor having supply means for suppling a ribbon, winding means for winding the ribbon supplied from said supply means, a support frame member for rotatably supporting said supply means and said winding means, ribbon feed means for feeding the ribbon from said supply means to said winding means, and adaptor stopping means provided on said support frame member for stopping said ribbon adaptor.

19. A cassette according to claim 18, further comprising engaging means for engaging a main body of the recording apparatus in attaching said cassette main body to the recording apparatus.

20. A cassette according to claim 18, wherein said adaptor attachment means also protects the ink ribbon exposed from said cassette main body.

21. A cassette according to claim 19, wherein said adaptor attachment means also functions as said engaging means.

22. A recording apparatus for recording onto a recording medium, comprising:

attachment means for attachment of a ribbon adaptor; and a ribbon adaptor, said ribbon adaptor having supply means for supplying a ribbon, winding means for winding the ribbon supplied from said supply means, a support frame member for rotatably supporting said supply means and said winding means, ribbon feed means for feeding the ribbon from said supply means to said winding means, and adaptor stopping means provided on said support frame member for stopping said ribbon adaptor;

conveying means for conveying the recording medium; and recording means for recording onto the recording medium.

23. An apparatus according to claim 22, wherein said adaptor further comprises attachment means for attachment of a ribbon cassette.

* * * * *

UNITED STATES PATENT AND TRADEMARK OFFICE

CERTIFICATE OF CORRECTION

PATENT NO. : 5,160,204 Page 1 of 2

DATED : November 3, 1992

INVENTOR(S) : Hisatsugu Naito, et al.

It is certified that error appears in the above-identified patent and that said Letters Patent is hereby corrected as shown below:

COLUMN 5:

Line 21, "as cam" should read --as shown in FIGS. 3A and 3B. The rack $5e_2$ mates with a cam--.
Line 32, "shaft 5f3." should read --shaft $5f_3$--.
Line 68, "gear $5f_7$" should read --idle gear $5f_7$--.

COLUMN 6:

Line 40, "state of" should read --state can be maintained in which an interlock projection $5g_5$ of--.
Line 55, "level portion $5g_4$" should read --lever portion $5g_4$--.

COLUMN 11:

Line 9, "of" should read --or--.

COLUMN 13:

Line 22, "positions 1-6" should read --positions 1 - 6--.
Line 44, "5" should read -- 5 --.
Line 59, "position in" should read --position 4 in--.
Line 68, "position 1" should read --position 1 --.

UNITED STATES PATENT AND TRADEMARK OFFICE

CERTIFICATE OF CORRECTION

PATENT NO. : 5,160,204 Page 2 of 2

DATED : November 3, 1992

INVENTOR(S) : Hisatsugu Naito, et al.

It is certified that error appears in the above-identified patent and that said Letters Patent is hereby corrected as shown below:

COLUMN 16:

Line 55, "of" should be deleted.

COLUMN 18:

Line 21, "suppling" should read --supplying--.

Signed and Sealed this

Eighteenth Day of January, 1994

Bruce Lehman

*Attest:*

BRUCE LEHMAN

*Attesting Officer*

*Commissioner of Patents and Trademarks*